US005233125A

United States Patent [19]

Bouver et al.

[11] Patent Number: 5,233,125

[45] Date of Patent: Aug. 3, 1993

[54] DEVICE FOR CONTROLLING AUTOMATIC LOADING OF A GUN

[75] Inventors: Gerard Bouver, St Etienne; Alain Larochette, Rive-de-Gier; Mohamad Ben-Ahmed, St Etienne, all of France

[73] Assignee: Creusot-Loire Industrie, Puteaux, France

[21] Appl. No.: 732,184

[22] Filed: Jul. 18, 1991

[30] Foreign Application Priority Data

Jul. 20, 1990 [FR] France ..... 90 09328

[51] Int. Cl.[5] ..... F41A 9/00; F41H 7/02; G06F 15/20; G05B 19/00

[52] U.S. Cl. ..... 89/36.13; 89/47; 89/34; 364/423

[58] Field of Search ..... 89/34, 36.13, 47; 364/423

[56] References Cited

U.S. PATENT DOCUMENTS

| | | | |
|---|---|---|---|
| 4,318,331 | 3/1982 | Echtler et al. | 89/34 |
| 4,442,753 | 4/1984 | Pouri et al. | 89/46 |
| 4,535,677 | 8/1985 | Panhke et al. | 89/34 |
| 4,671,164 | 6/1987 | DeHaven et al. | 89/34 |
| 4,777,864 | 10/1988 | Siech et al. | 89/45 |

FOREIGN PATENT DOCUMENTS

| | | |
|---|---|---|
| 105101 | 4/1984 | European Pat. Off. . |
| 217059 | 4/1987 | European Pat. Off. . |
| 2501425 | 7/1975 | Fed. Rep. of Germany . |

OTHER PUBLICATIONS

Jenkins, Von D. H. C., "Ladeautomaten für Panzer", Internationale Wehrrevue, Jul. 1984, pp. 907-918.

*Primary Examiner*—Stephen C. Bentley
*Attorney, Agent, or Firm*—Cushman, Darby & Cushman

[57] ABSTRACT

An apparatus for controlling the automatic loading of a gun of an armored vehicle gun turret has a rotating magazine, a rammer, at least one munitions type sensor, a selection unit, a control unit, and a managing device. The rotating magazine has cells for storing munitions, and is disposed in proximity to a chamber of the gun. The rammer rams munitions stored in the rotating magazine towards a chamber of the gun. The munition type sensor detects a type of munition stored in a cell of the rotating magazine. The selection unit selects a type of munition to be used. The control unit controls the rotating magazine to position a selected type of munition for loading into the chamber of the gun, the rammer to ram the selected type of munition towards the chamber of the gun, and a transfer of the selected munition from the rammer towards the chamber of the gun. The managing device manages the munitions stored in the rotating magazine, and instructs the control unit based on the output of the munition type sensor and the selection unit.

17 Claims, 18 Drawing Sheets

137
115
132
119
116
118B
117B
116B
134
131
129
130
126
127
128
121
140
133
135
T
136
125
123
120
122
116A
117A
118A
139
124

DEVICE FOR CONTROLLING AUTOMATIC LOADING OF A GUN

BACKGROUND OF THE INVENTION

The present invention relates to device for automatically loading rotating magazines for guns, especially guns equipping turrets of armored vehicles.

In vehicles of this type, it is necessary to have available a great capacity for munitions storage and to be able to transfer the munitions stored in the rotating magazine as rapidly as possible to the weapon chamber.

Modern armored vehicles are led into utilizing munitions of various types as a function of the conditions with which these vehicles are confronted in the field.

It is, therefore, likewise necessary to have available means which are capable of selecting, in a very reliable manner and in a minimum of time, the type of munition which the gun commander decides to employ.

The devices for controlling loading existing until now are essentially mechanical and electromechanical devices which generally require active manual intervention on the part of the operator, which renders their operation relatively slow and, for this reason, inappropriate to the often extremely rapid changes in field conditions.

As a result of the existence of extremely rapid and precise means for the detection of armored vehicles, the latter have available only a very short time in which to strike at a target and disappear before being detected.

Consequently, the known means for controlling loading are often inappropriate by reason of their relatively slow operation.

SUMMARY OF THE INVENTION

The present invention aims to remedy the disadvantages of the known devices for controlling loading, by creating a device for controlling loading which combines rapid and sure operation with a very reliable selection of the type of munition to be utilised.

The subject of the invention, therefore, is a device for controlling automatic loading of a gun, in particular of a gun equipping an armored vehicle turret, comprising a rotating magazine intended to store munitions, the said magazine being disposed in proximity to the chamber of the gun and being associated with a device for ramming the munitions stored in the magazine towards the chamber of the gun, characterized in that it further comprises electronic means for managing the munitions stored in the magazine, means for recognizing the type of munition found in each location of the rotating magazine, means for selecting the kind of munition to be used, means for controlling the displacement of the rotating magazine with a view to dispatching it towards the device for ramming the munition of the selected type and means for controlling the transfer of the said munition by the ramming device towards the chamber of the gun.

BRIEF DESCRIPTION OF THE DRAWINGS

The invention will be better understood by means of the description which will follow, given solely by way of example and made by referring to the attached drawings, in which.

DETAILED DESCRIPTION OF THE PREFERRED EMBODIMENTS

Figure 1:
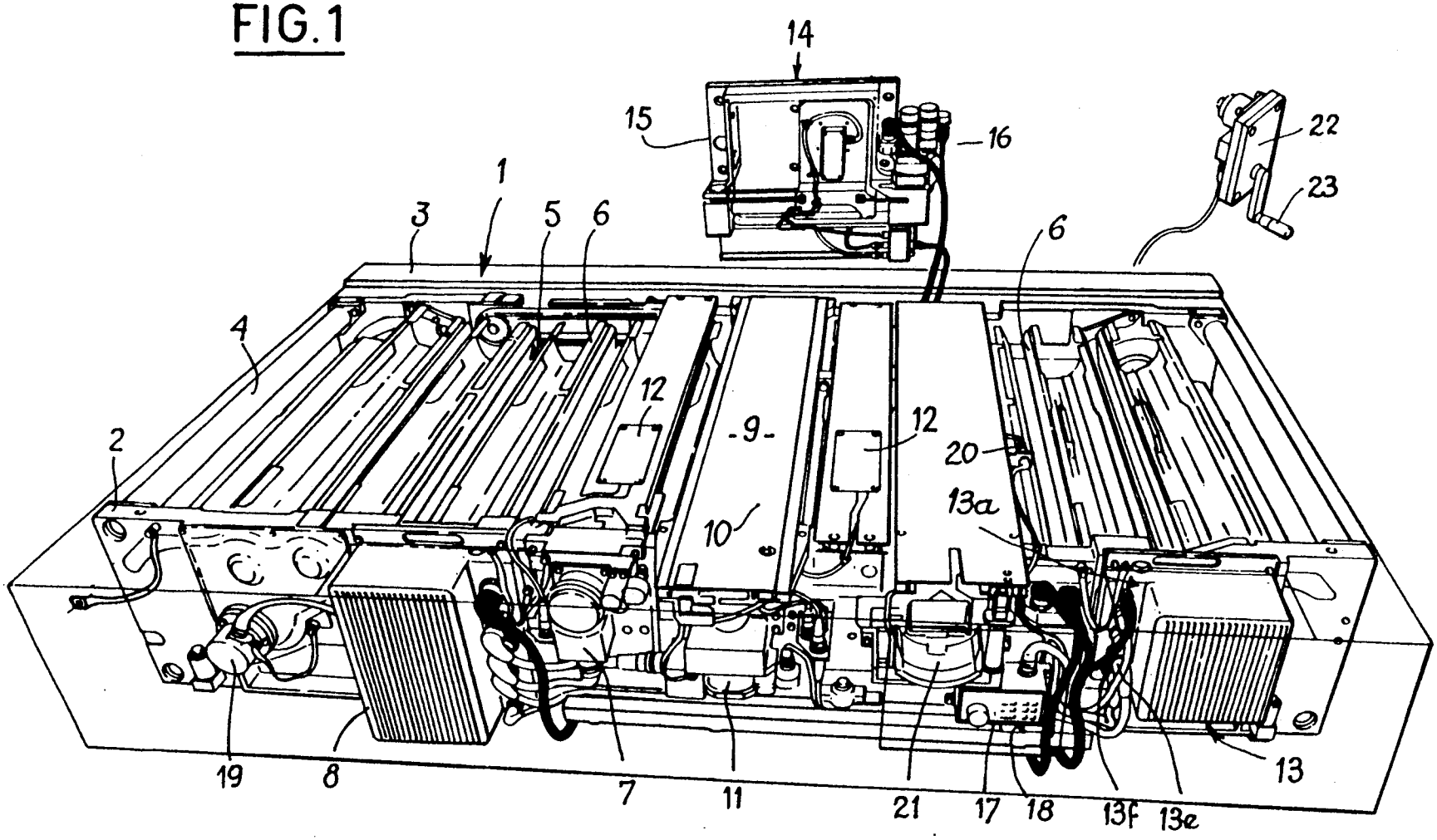
FIG. 1 is a diagrammatic perspective view of a device for loading munitions for a gun of an armored vehicle to which is applied the automatic-control device according to the present invention.

The loading device represented in FIG. 1 consists of a chassis 1 having a flattened parallelepipedal shape, formed essentially by two rectangular panels 2, 3 joined by cross-pieces 4 fixed between the ends of the panels.

In the chassis 1 is mounted an endless conveyor 5 formed by cells 6 for reception of munitions.

The conveyor 5 is driven in the two directions of displacement by a DC electric motor 7 via a reducing gear and chain mechanism (not shown).

The motor 7 for driving the conveyor is mounted on the panel 2 of the chassis, beside a box 8 for controlling motors, which box is likewise fixed to the said panel 2.

The device of FIG. 1 further comprises a ramming device or rammer 9 situated in the middle of the upper strand of the conveyor 5 and which is intended to bring about the transfer of a selected munition towards the chamber of the gun, for example of the gun of an armored vehicle (not shown) which is associated with the device.

The rammer 9, the construction of which is masked by a cover plate 10 and which comprises mechanical means for pushing the munition contained in the cell 5, brought into the ramming position, towards the chamber of the gun, is driven by a DC electric motor 11 likewise controlled by the box 8 for controlling the motors.

On either side of the position of the rammer 9 are placed sensors 12 for identifying munitions.

In the present example these are sensors for reading bar codes carried by the munitions and identifying the type of each of the munitions introduced into the conveyor.

The motor 11 for actuating the rammer 9 is likewise carried by the panel 2 of the chassis 1.

On this panel, which constitutes in fact the control panel of the device, is also fixed a box 13 containing the computer of the device.

At the end of the rammer 9, opposite the motor 11 for actuating the latter, is disposed a door assembly 14 on the mounting 15 of which there is disposed a DC motor 16 for driving a separation door of the rammer 9 and the breech (not shown) of the gun which are intended to be powered by the device.

The motor 16 is itself also controlled by the box 8 for controlling motors.

The panel 2 of the chassis 1 further carries an interface 17 with a keyboard 18 for man-machine connection which, in association with the computer contained in the box 13 and the device 8 for controlling the electric motors 7, 11 and 16, ensures the automatic control of the loading device in regard to the operations of provisioning and evacuating of the magazine.

At the left-hand end of the panel 2 is also disposed an absolute sensor 19 for positioning the cells 6 of the conveyor 5.

On the upper portion of the device is disposed a sensor 20 for the locking of the provisioning and evacuating device 21 placed in the proximity of the rammer 9 and making it possible to ensure the internal provisioning and the external provisioning of the magazine or conveyor 5 as well as the evacuating thereof.

The loading device also comprises a current generator 22 provided with a starting handle 23 and intended to produce manually the energy necessary for the powering of the motors of the device in the event of a breakdown of the power system.

Of course the various electrical and electronic constituents of the device are connected to each other by appropriate conductors for transmitting power and data.

Figure 2:
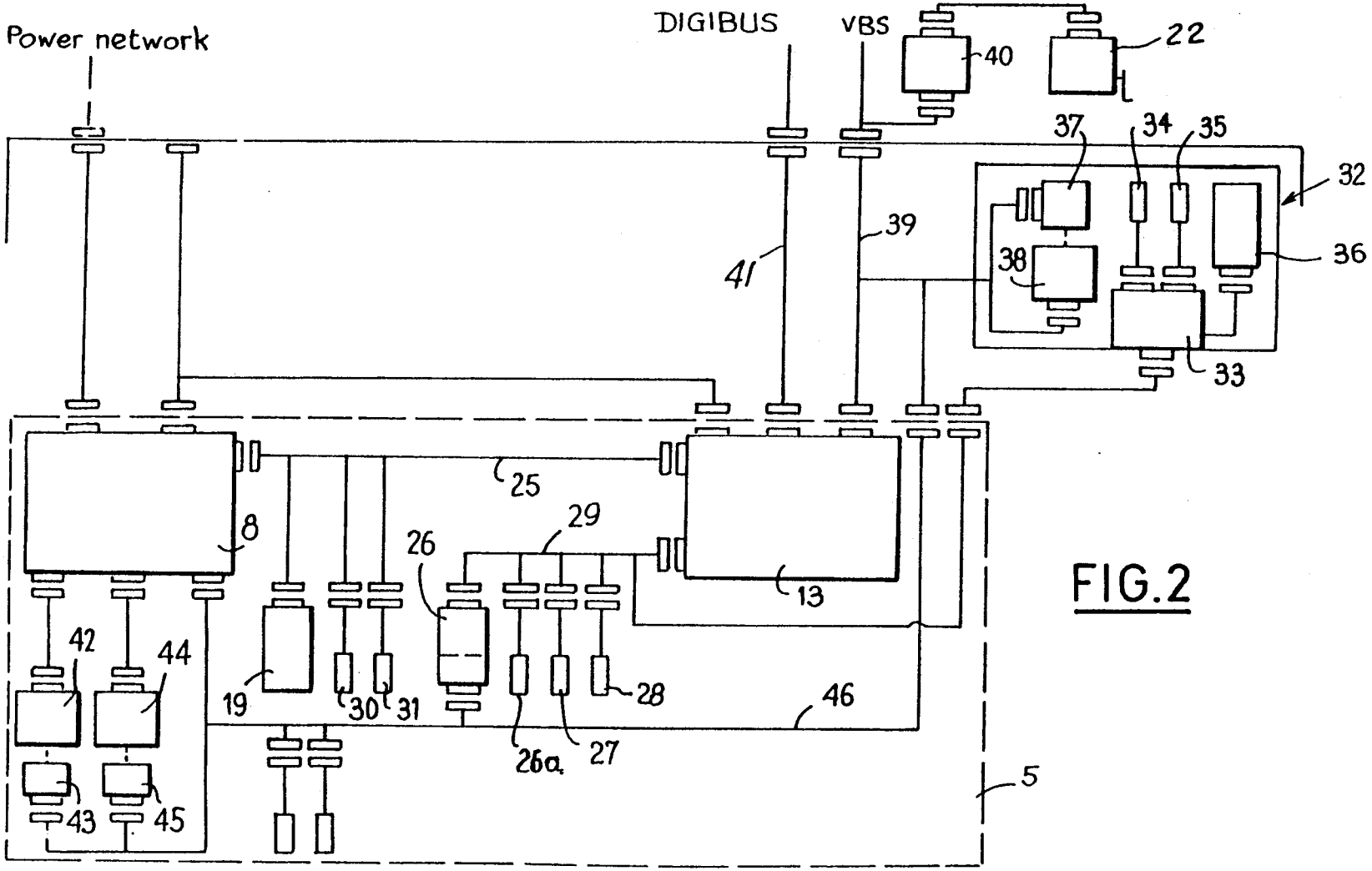
FIG. 2 is a schematic diagram of the device for controlling automatic loading according to the invention equipping the loading device of FIG. 1.

The schematic diagram of FIG. 2 shows the overall system of the device for controlling automatic loading according to the invention.

This device principally comprises, associated with the conveyor 5, the electronic box 13 of the computer or BECAL connected by a line 25 to the box 8 for controlling the motor.

The BECAL 13 is further connected to an electronic box 26 for external provisioning, to a sensor 26*a* of the presence of a munition in the loading station FCPMC, to a sensor 27 of returned rammer FCRRE and to a sensor 28 of locked equipment FCORE.

The electronic box 26 and the three sensors 26*a*, 27 and 28 are connected to the BECAL box 13 by a common line 29.

The box 13 of the computer is further connected via the line 25 for connection with the BECMO box 8 to the BECOD box of the absolute encoder 19 of FIG. 1, to an electronic box BEIMD 30 containing the right-hand munition-identifying sensor 12 and to an electronic box BEIMG 31 containing the left-hand munition-identifying sensor 12.

The of the BECAL box 13, which input is connected to the sensors 26*a*, 27 and 28, is further connected to an input of an electronic system for controlling the door which separates the rammer 9 (FIG. 1) from the breech of the gun (not shown) and which ensures the isolation of the device for automatic loading in relation to the rest of the turret.

The electronic assembly 32 comprises a box BJPOR 33 connected on, the one hand to the aforementioned input of the BECAL 13 and, on the other hand to a sensor 34 of closed door FCPFE, to a sensor 35 of open door FCPOU and to an electronic box 36 for empty chamber BECHV.

The door electronic assembly 32 comprises a main door motor MPORT 38 and an auxiliary door motor MAPOR 37. The MPORT motor 38 is connected to the BECMO circuit via a line 46. The MAPOR motor 37 is connected to the manually controlled generator by a line 39.

The line 39 is connected to the on-board sensitive power supply network VBS.

To the line 39 is likewise connected the manual generator 22 via, possibly, a PUPRM circuit 40 for selecting auxiliary motors 37, 43, 45.

To the BECAL box 13 is further connected a serial network for on-board communication 41. In the present example, this network is constituted by a DIGIBUS line.

The device of FIG. 1 further comprises a reduction gear motor 42 for the MCONV conveyor and an auxiliary motor for the MACON conveyor 43.

The motor 43 is connected to the generator 22 by the lines 46 and 39. The motor 42 is connected to the BECMO box 8. The reduction gear motor 44 is itself also connected to the BECMO box. The MAREF motor 45 is connected to the generator 22 by the lines 46 and 39.

There will now be described by reference to FIG. 3 the computer of the automatic control device contained in the BECAL box 13 of the diagram of FIG. 2.

The computer contained in the box 13 comprises, in the form of separate boards, a central processing unit 50, a DIGIBUS board 51, a set of memories 52, a first set of serial link input-outputs 53 and a second set of serial link input-outputs 54.

The boards 50 to 54 are connected by a common bus 55 to voltage converting boards 56, 57, 58 and to a test board 59.

The board of the central processing unit 50 is connected to an isolated system checking utility, OSCI, by a serial link 50*a*.

The DIGIBUS board 51 is connected to the digibus by a serial link 60.

The input-output boards 53 and 54, respectively, are connected to actuators and sensors of the diagram of FIG. 2 by links 61 and 62..

In the present example, the box 13 of the computer may receive at least 10 boards. Thus, as may be seen in FIG. 1, this box comprises a socket mounting 13*a* on which are provided power, digibus, test and input/output sockets, respectively, 13*b*, 13*c*, 13*d*, 13*e* and 13*f*, associated with the corresponding boards of the box.

This computer is composed of hardware and software.

The converter board 56 is a board providing a voltage of +5 V powering all the logic boards of the computer.

The converter board 58 provides a voltage of +16 V in order to power all the sensors of the device for automatic loading.

The converter board 57 provides a voltage of 15 V and a voltage of 5 V, and powers the DIGIBUS board 51 as well as amplifiers of the serial links of the computer and a portion of the circuit situated in the BECMO housing 8.

All the boards are mounted in the computer housing 13 of FIG. 1 and occupy a backplane slot. Each of these boards utilizes a single 96-way plug socket connector of the HE 804 series.

Figure 4:
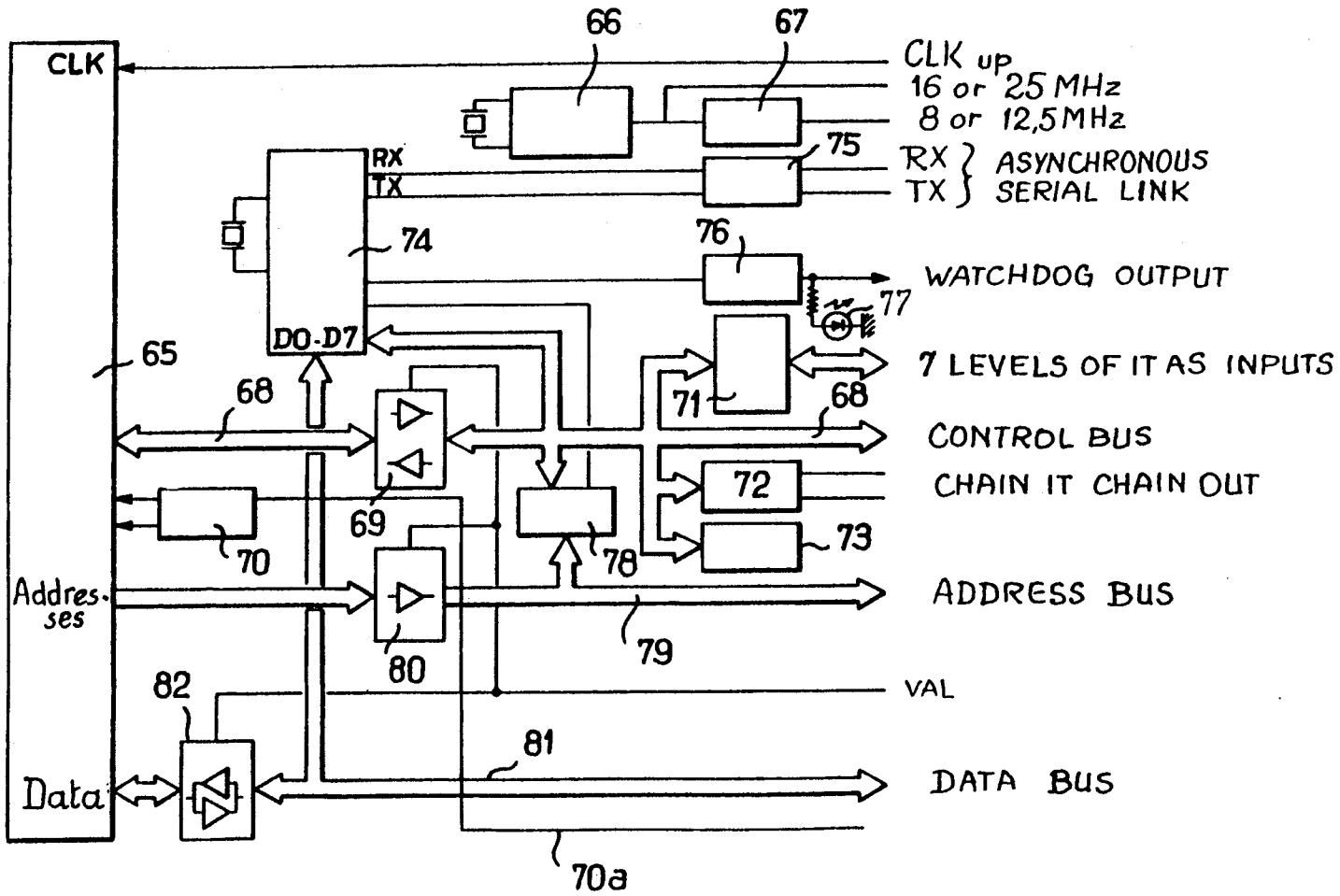
FIG. 4 is a more detailed schematic diagram of the central unit coming into the construction of the computer of FIG. 3.

Reference will now be made to the diagram of FIG. 4 in order to describe the central processing unit of the computer.

The board 50 for the central processing unit of the computer contained in the BECAL box 13 is organized around a 16 bit 68000 microprocessor 65.

This board defines at the computer level a 16 bit data bus and a 23 bit address bus.

The working frequency of the microprocessor is fixed at 8 MHz but it may be fixed at 12.5 MHz by a simple component change.

This board ensures correct operation of the software set up in the memory board 52.

It permits the following functions:

Real-time operation

Checking of the overrun of the run-time of the software

Checking of the memory access time or of a peripheral device and processing a Bus Error exception Management of system interrupts To ensure an isolated serial link.

The microprocessor 65 comprises a clock input CLK to which is connected a 16- or 25-MHz clock signal generator 66, either directly, or via a divider by two 67, so as to apply thereto either clock signals of frequency equal to 16 or 25 MHz, or clock signals of frequency equal to 8 or 12.5 MHz.

The microprocessor 65 comprises control inputs/outputs connected to a control bus 68 into which is inserted a buffer circuit 69.

The microprocessor 65 is further connected to a restart logic unit 70 as well as to an interrupt priority coder 71, a hard-wired logic unit for hierarchizing interrupts, commonly called "DAISY CHAIN" 72 and a controller 73 of access time to the memory.

The control bus 68 is moreover connected to a circuit 74, consisting of four programmable counters, which is connected to an isolating circuit 75, to a watchdog memorizing circuit 76 delivering a watchdog signal at its output and connected up to an indicator light 77 consisting of an electroluminescent diode. Moreover, the circuit 74 is connected up to a decoding logic unit 78 likewise connected to the control bus 68.

The circuit 74 ensures the generating of a real-time clock, of the basic clock for the asynchronous serial link comprising the circuit 75, and the temporization of the watchdog security.

The decoding logic unit 78 is connected to an address bus 79 itself connected via a buffer circuit 80 to the microprocessor 65.

Moreover, the microprocessor 65 comprises a set of data inputs/outputs to which is connected a data bus 81 into which is inserted a buffer circuit 82.

The buffer circuits 69, 80 and 82 inserted into the control, address and data buses 68, 79 and 81, are controlled by signals VAL for setting to the high-impedance state under emulation.

Transfer of data from the microprocessor 65 is performed asynchronously. For each memory or peripheral access, the microprocessor awaits a response from its interlocutor ($\overline{\text{DTACK}}$ signal).

The time after which the $\overline{\text{DTACK}}$ signal is confirmed depends on the access time of the memory or of the corresponding peripheral.

The central processing unit 50 substantiates that the response to the access to the memory intervenes within a given time period. In the event of an overrun, a Bus Error item of error information is sent to the microprocessor 65 producing a $\overline{\text{BERR}}$ exception.

The central processing unit board 50 ensures the management of the system.

It possesses seven interrupt levels. The priority coder 71 codes these levels in three items of information accessible to the microprocessor 65.

Several interrupts of the same level can be generated.

The central processing unit takes into account both vectorized interrupts arising from 68000 peripherals and autovectorized interrupts which may arise from 6800 peripherals for example.

Management of interrupts of the same level is carried out by the "DAISY CHAIN" logic unit. "DAISY CHAIN" is a priority management mode which, for each peripheral requesting an interrupt, requires one specific input line and one specific output line.

When interrupts of the same level are requested simultaneously by several peripherals, the one whose interrupt level corresponds to that requested and whose $\overline{\text{CHAININ}}$ is in the low state has its interrupt taken into account and sets its $\overline{\text{CHAINOUT}}$ output signal to the high state.

The peripheral situated immediately afterwards in the chain is then advised that its interrupt has not been taken into account and likewise sets its $\overline{\text{CHAINOUT}}$ to the high state.

Therefore, this priority mode is obtained by hardwiring.

The structure of the central processing unit board 50 is such that the microprocessor 65 is continuously in control of the bus, in operational mode. By contrast, the same is completely disconnected from the bus in emulation mode.

The restart logic unit 70 ensures the $\overline{\text{RESET}}$ line for stopping and restoring is maintained at the low state for a given time, greater than 100 ms for example. When the housing 13 is powered up, the initializing signal is furnished by the converter board 56.

On powering up the subsystem, the microprocessor runs a program for initializing the various functions provided on the board.

The signals of the control, data and address buses 68, 79 and 81 of the microprocessor 65 which exit on the corresponding connector of the board are amplified.

They ensure the interface with the other boards of the computer and the complete disconnecting of the microprocessor 65 during trials performed with the aid of an emulation utility.

This disconnecting of the microprocessor is performed by setting to the high logic state the signal VAL emitted on the connector of this board.

The address, data and control buses can then be driven by an emulation utility through the connector of the central processing unit board.

Real-time operation of the central processing unit is ensured by virtue of a counter 74 which generates interrupts at fixed time intervals.

These time intervals are software-programmable. Reading the value of the counter is possible and does not disturb the operation of the system.

The interrupt generated by the real-time clock 66 is acknowledged by the microprocessor 65 when accounting for it.

This interrupt is accessible on the output connector of the central processing unit board and is transmitted over one of the seven interrupt lines of this same board.

Checking of the execution time of one logic frame is performed by the up-/down-counter or watchdog 76 loaded with an initial value during initialization of the board and which must be periodically reloaded with this value using software.

If a logic error (frame distortion, logic emergency) intervenes and if the up-counter 76 is not activated in time, a specific output changes state and an interrupt is generated.

The level of this interrupt is selected in the same way as for the real-time clock 66.

The output of the watchdog 76 may be used to give an item of information about its state or to deactivate an arbitrary element.

In the event that the watchdog 76 is turned off, the only way of rearming it is to cause a resetting to zero on the microprocessor 65 which entails a reinitialization of the hardware elements of the board 50.

An asynchronous serial link of the RS 422 type, conforming with report VII of the CITT, is made available on the output connector for uses intrinsic to the application employing this link (in particular, it can be a link for dialog with another computer).

The signals required for this link are electrically isolated from the voltage for powering the board. Only the data transmission lines are used.

The control format as well as the number of useful bits comprising the character to be transmitted or to be received, is programmable.

The speed of transmission is likewise chosen through software. It can be chosen from the following speeds: 2400, 4800, 9600 and 19200 baud.

A vectorized interrupt can be transmitted to the microprocessor 65 either on transmission or on reception of characters on the serial line, on particular events (error of transmission and of reception for example).

This serial link is autotestable for the central processing unit board itself.

In the present example, the electrical interface of the central processing unit board 50 is, with the other boards of the computer, produced by a parallel bus analyzed as follows:

the 16-bit data bus 81 the 23-bit address bus 79 the bus 68 for control of the microprocessor 65 bits for managing the interrupt "DAISY CHAIN"

seven interrupt inputs an isolated, protected serial link ensuring the interface with the outside the initializing line 70a connected up to the restart logic unit 70.

Figure 5:
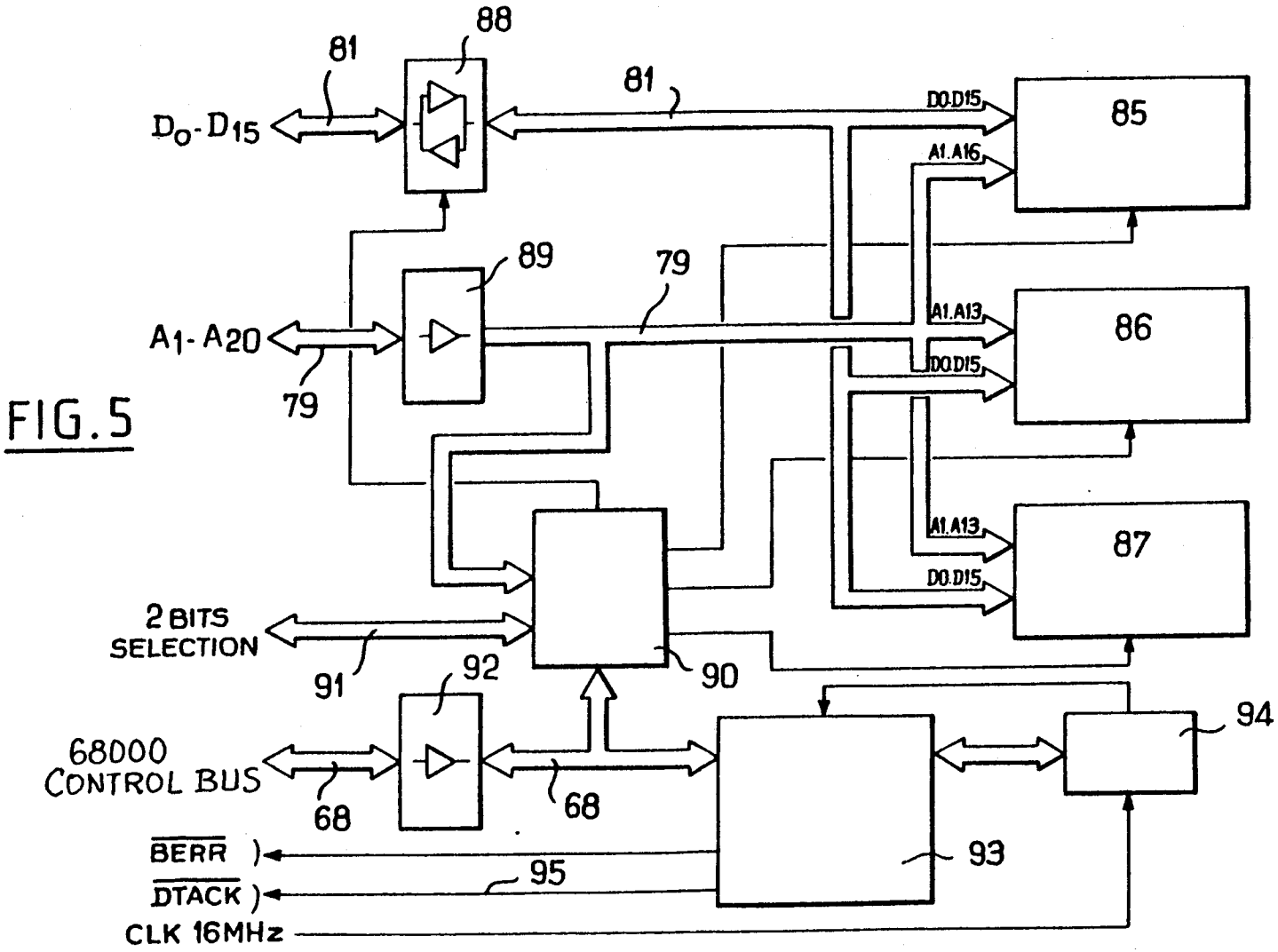
FIG. 5 is a more detailed schematic diagram of the memory board forming part of the computer represented in FIG. 3.

The memory board 52 of the computer represented in FIG. 3 will now be described with reference to FIG. 5.

This board is intended to contain, in EPROM and PROM memories, the software for the device for automatic loading.

It has the further aim of ensuring the retention of information vital to the automatic loading during periods when the device is switched off (savable memories).

The updating of these data is carried out within a very short time period.

Moreover, the memory board 52 has the function of placing at the disposal of the central processing unit 50 the RAM random-access memory required for the correct operation of the software.

The circuit of the memory board 52 comprises a block of read-only memories 85, a block of backed-up memories 86 and a block of random-access memories 87.

The block of read-only memories 85 is connected to the data bus 81 coming from the central processing unit board 50, via a buffer circuit 88.

The data bus 81 is further connected to the memory blocks 86 and 87.

Furthermore, the memory blocks 85 to 87 are connected to the address bus 79 via a buffer 89.

Moreover, the address bus 79 is connected to a logic unit 90 for decoding memory zones which ensures control of the memory blocks 85 to 87.

The decoding logic unit 90 is connected on the one hand to a line 91 carrying two selection bits and on the other hand to the control bus 68 via a buffer circuit 92. The bus 68 is connected in turn, on the output side of its link with the decoding logic unit 90, to a logic unit 93 for managing exchanges and for generating the error signal.

The latter is in turn connected to an up-counter 94 for generating the $\overline{\text{DTACK}}$ signal controlled by a 16-MHz clock signal likewise applied to the management logic unit 93.

The generating and exchange management logic unit 93 delivers a signal $\overline{\text{BERR}}$ and a signal $\overline{\text{DTACK}}$.

The memory board serves as medium for the software for the automatic loading.

Two selection bits applied to the logic unit 90 for decoding memory zones make it possible to decode the board and to situate a 4-M byte memory zone defined in this board among the 16 addressable M bytes of the microprocessor 65.

In operational mode, the memory board 52 is powered from the board 56 likewise contained in the BECAL box 13.

In programming mode, the various voltages and signals required are furnished by the read-only memory programming utility.

The block of read-only memories 85 or EPROM zone contains the automatic loading software and is accessible only in read mode. This block being permanently mounted, can be programmed through a connector.

According to the present embodiment it has a capacity of 128 K words.

Reading is performed either on bytes, or on 16-bit words.

This zone is likewise divided into two zones:

a supervisory zone whose capacity can be modulated from 4 to 64 K words, a user zone of 128 K words less the capacity of the supervisory zone and expandable to 256 K bytes.

This division permits a bus error signal $\overline{BERR}$ to be generated in the event of random addressing.

The block or random-access memories 87 or RAM zone contains the data computed by the central processing unit as a function of the running of the program.

It has a capacity of 16 K words expandable to 32 K words using a different programming of the programmable logic circuits performing the decoding of the various memory circuits of the board.

The maximum access time in read mode and in write mode of a datum in this memory zone is 150 ns.

The memory zone for saving information or backed-up memory block 86 contains data relating to the operation over time of the automatic loading (e.g. indicator of wear to the parts).

It has a minimum capacity of 512 bytes and can be chosen from the two technologies, NOVRAM and EE PROM.

The data are accessible in bytes and in the odd addresses only.

The updating of the data can be carried out in two different ways.

Continuously: in this case, loss of the +5 V network locks this memory zone so as to eliminate any risks of alteration to this zone.

On disappearance of the responsive 28 V network:

In this case, loss of the 28 V network is signalled to the computer. This signal causes the saving of the data. The maximum time for performing this saving is 10 ms.

This time corresponds to the minimum time for maintaining the +5 V voltage after cutting of the responsive network. The access time in read mode of a datum in this memory zone is 250 ns.

Depending on the technology used, the energy required for the saving can be contributed either by an internal circuit, or by the board 57.

The memory board generates a signal $\overline{DTACK}$ intended for the microprocessor 65 to which it is connected by a line 95. The signal $\overline{DTACK}$ is transmitted to the microprocessor for each access so as to signal to it that the exchange was performed correctly.

It is returned after a time greater than the write-mode or read-mode access time of the memory box concerned.

There will now be described, with reference to FIG. 6, one of the serial link and input/output boards 53, 54 of the computer shown in FIG. 3.

Figure 6:
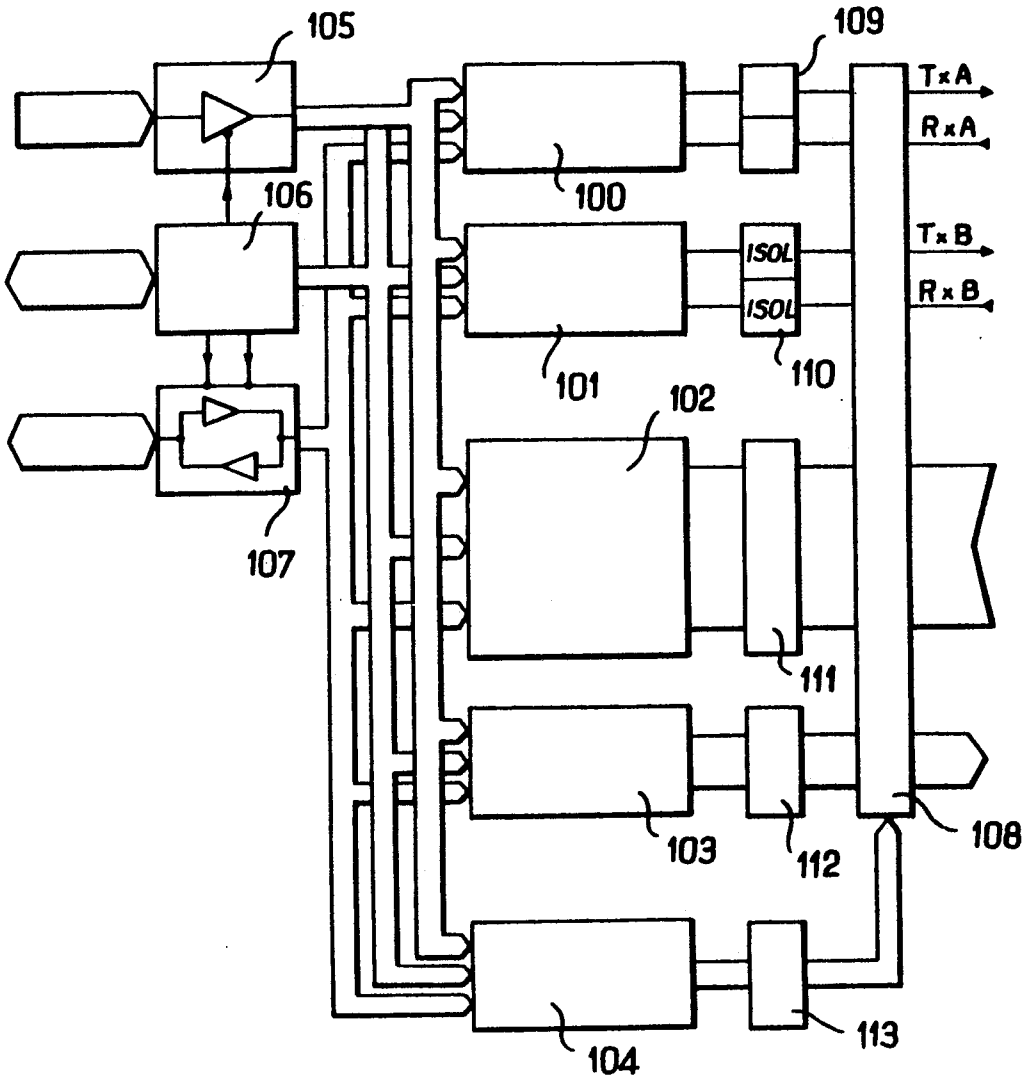
FIG. 6 is a more detailed schematic diagram of a serial link input/output board forming part of the computer of FIG. 3.

The board shown in FIG. 6 must make it possible to ensure exchanges of information between the central processing unit board 50 of the computer and the peripherals which this board must manage or check.

For this purpose, the board comprises two serial links 100 and 101, a port 102 with ten all-or-nothing inputs, a port 103 with four all-or-nothing outputs.

The serial links are of the asynchronous type operating in full duplex mode.

In the present example, the speed of transmission is fixed at 9600 baud.

The inputs for the reception signals as well as the outputs for the transmission signals are electrically isolated and protected against short circuits.

The inputs 102 are of the type enabling the computer to find out the logic state of peripheral devices such as sensors, control elements, etc. when the computer addresses then reads the state of a port to which these inputs are connected.

The outputs enable the computer to send the items of control information to peripherals such as indicator lights or similar, via output ports which it addresses and into which it writes the state of the corresponding outputs.

The input/output board of FIG. 6 is designed to operate under the control of the central processing unit board 50 of the computer equipped with a 68000 microprocessor. Address recognition of the board is achieved at the level of the connector by two selection bits fixed by backplane and the bus 79.

Referring again to FIG. 6, it is observed that the input/output board further comprises a test logic unit 104 connected to the serial links 100 and 101, to the input port 102 and to the output port 103, respectively.

The board is connected to the bus of the microprocessor via a unidirectional interface circuit 105 inserted in the address bus, via a control decoding logic circuit 106 inserted in the control bus and via a bidirectional interface circuit 107 inserted in the data bus.

The inputs/outputs of the board are connected to a test input circuit 108 associated with the test logic unit 104 via corresponding isolating circuits 109 to 113.

The board just described comprises a system for autotest by feeding back from the transmitter to the receiver. The test is done on two control bytes. These operations are controlled by autotest software.

The board comprises a system for testing the inputs by successively setting all the inputs to the low state then to the high state. These operations are controlled with the aid of the abovementioned autotest software.

The board further comprises a system for testing output by re-reading the latter. These operations are controlled with the aid of the autotest software.

The selection of the board of FIG. 6 is made by decoding of the address bits A20, A21, A22, A23. The addressing, organization and initialization of the input ports, of the output ports, of the internal registers and of the serial links are defined as a function of the type of hardware used to construct the board.

The input/output and serial link board generates autovectorized interrupt requests following reception of a bit string on one or other of the two serial links, or following a logic state field of one of the all-or-nothing inputs. The various interrupt requests generated by the board all have the same level. Therefore, they are therefore grouped together on a single interrupt line. The interrupt request output is of the open collector type and is active at the low logic level.

In the serial link input/output board the serial links take priority over the all-or-nothing inputs.

Figure 3:
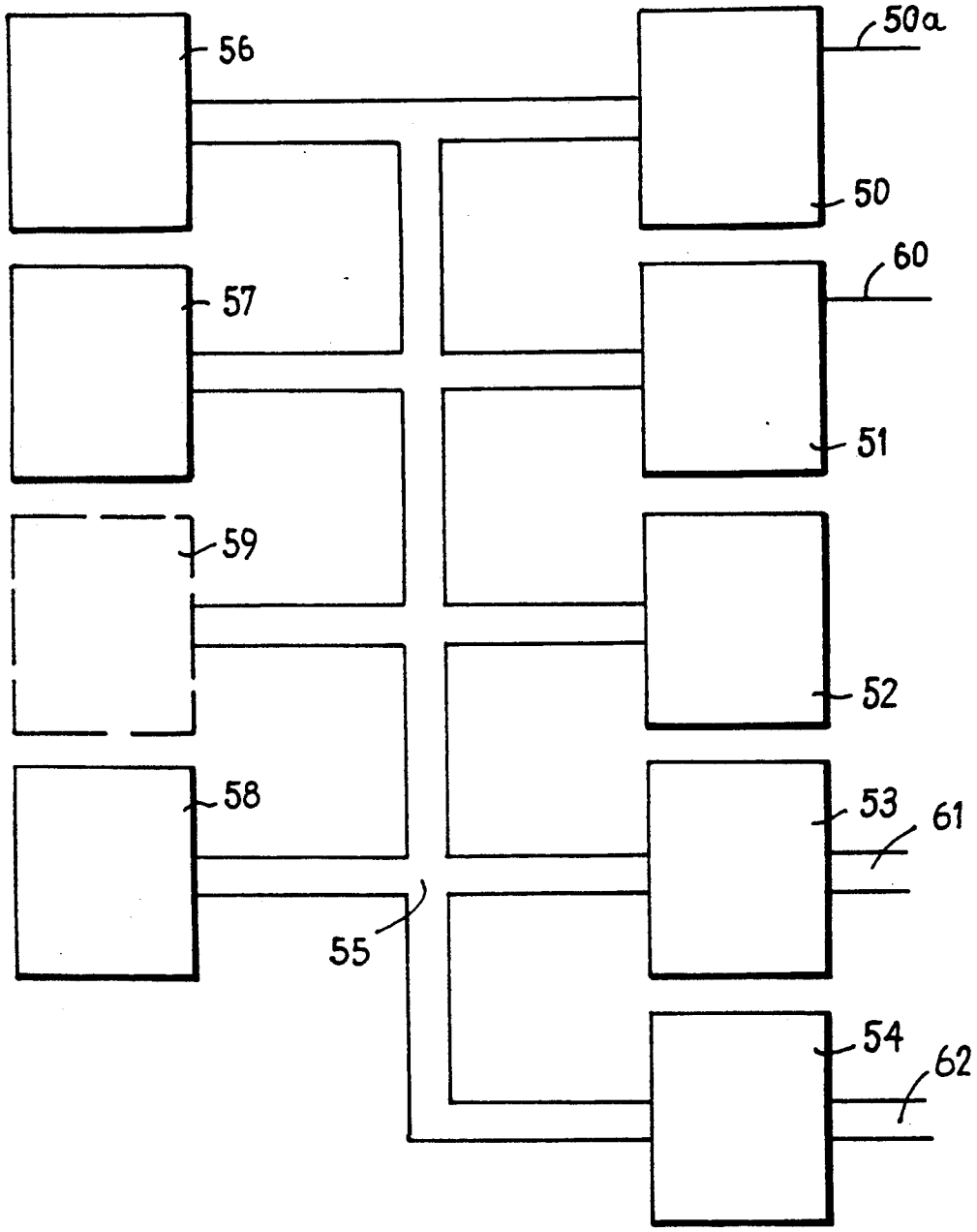
FIG. 3 is a more detailed schematic diagram of the on-board computer forming part of the control device of FIG. 2.

Of course, the serial link and input/output boards 53 and 54 of the computer of FIG. 3 are identical.

The computer represented in schematic form in FIG. 3 comprises finally a certain number of power supply boards such as the boards 56 to 58 and, optionally, a diadem test board. These boards are not described here.

Returning to the schematic diagram of the device for controlling automatic loading shown in FIG. 2, the contents of the BEMCO box 8 for control of the motors of a conveyor will now be described.

Figure 7A:
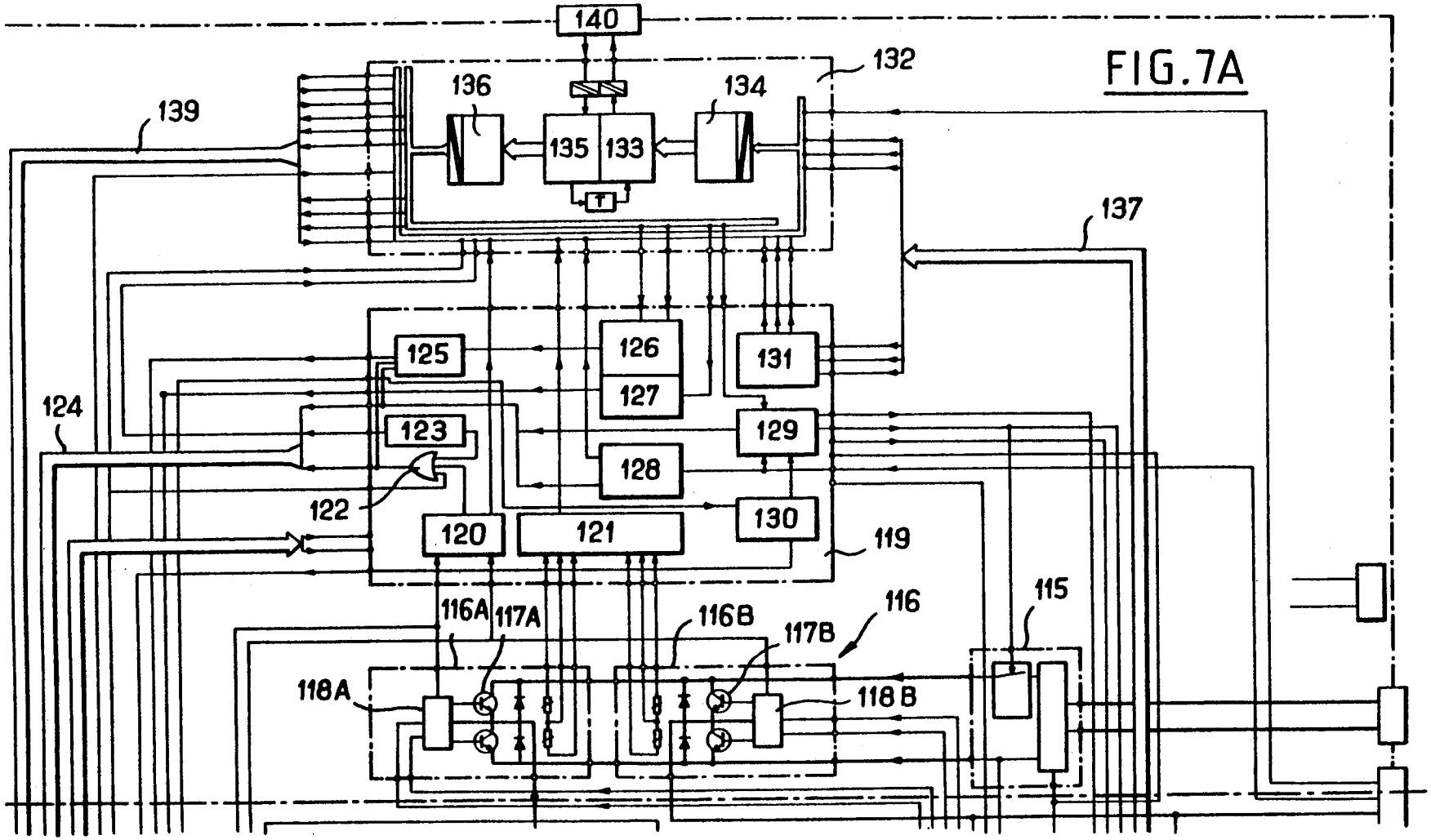
FIGS. 7A, 7B represent together the detailed schematic diagram of the device for controlling the electric motors for driving the essential members of the loading device of FIG. 1.
Figure 7B:
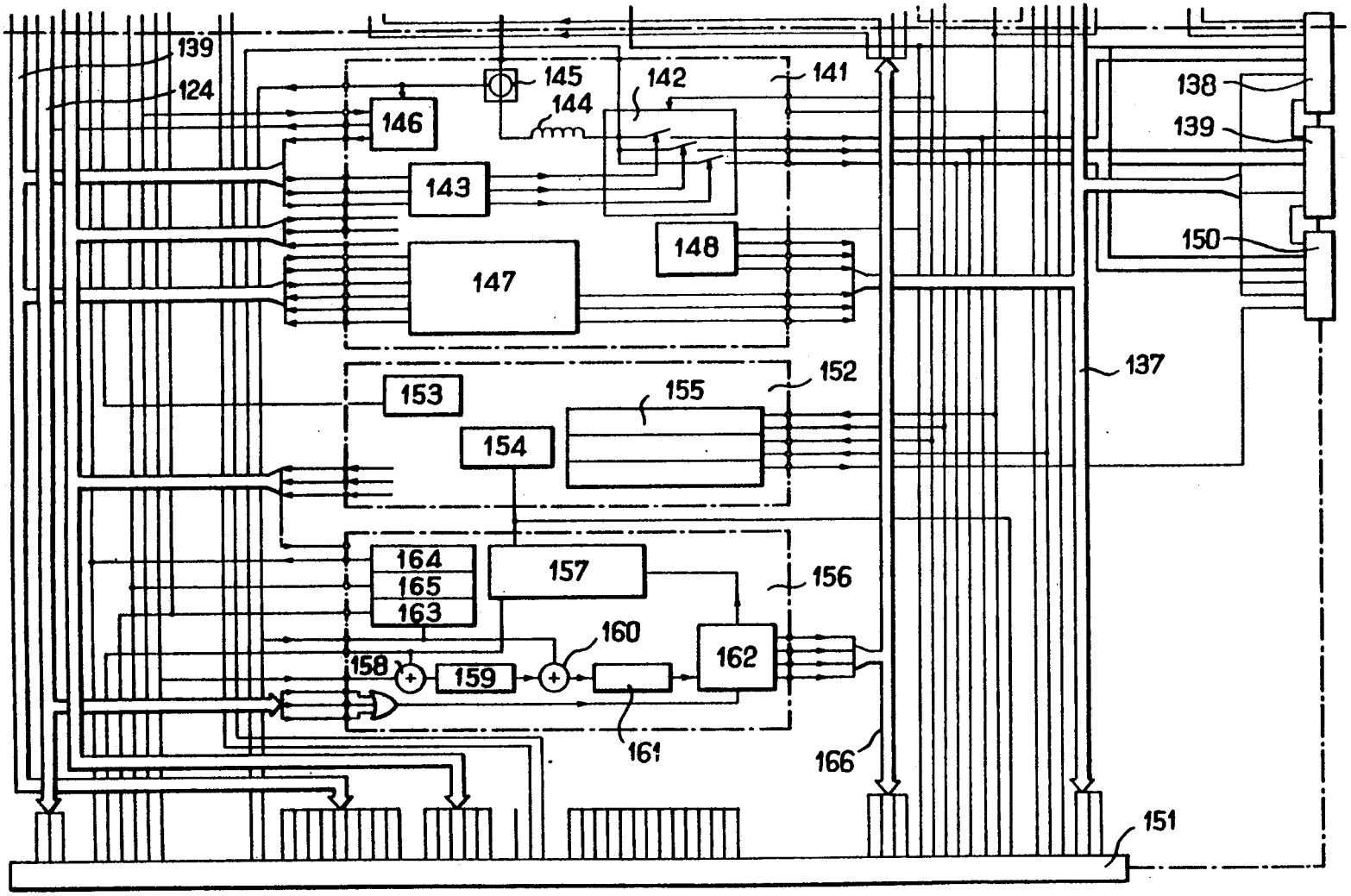

The circuit at BECMO box 8 is shown in FIGS. 7A and 7B taken together.

The circuit shown in these Figures serves as interface between the motors 7, 11 and 16 of the conveyor, of the rammer and of the door. The three functions of ramming, conveying and maneuvering the door being independent and not simultaneous, control of them is ensured following the method of switched actions. This makes it possible to use a single power device and a single speed servocontrol system for the three motors to be controlled.

Considering firstly FIG. 7A, the system comprises a filtering module 115 ensuring the distribution of electrical energy for various subassemblies. The filtering module is connected up between the power network and a power bridge 116 ensuring power supply for each of the electric motors 7, 11, 16. The power bridge 116 consists in fact of two half-bridges 116A, 116B with transistors 117A, 117B disposed in pairs and ensuring control of the rotation of the associated motor.

Each of the half-bridges 116A, 116B is completed with a circuit 118A, 118B for control of the corresponding transistors 117A, 117B. A check circuit 119 is connected up to the power bridge 116. This circuit brings together the functions of checking the housing 8 as well as producing the speed setpoint for each of the motors under consideration.

Three rates are possible as well as two directions of rotation:

- fast speed for displacing between two positions or full speed,
- slow speed for improving the precision of the stopping position, for limiting the energy dissipated in the braking means when stopping,
- intermediate speed for the phases of reconfiguring the system and for the rammer and conveyor tests, the intermediate speed being equal to half the fast speed.

The check circuit firstly comprises a monitoring circuit 120 for the power supply of the control circuits 118*a*, 118*b* of the power bridge 116 and a circuit 121 for monitoring the temperature of the power half-bridges 116*a* and 116*b*.

The circuit 120 for monitoring the power supply for the control circuits 118A, 118B is connected up to an input of a hard-wired OR 122 a second input of which is connected up to a circuit 123 for monitoring the voltage of the network and a third input of which is connected up to a power supply board which will be described with reference to the part of the circuit shown in FIG. 7B. The output of the OR 122 is connected up by a bus 124 for linking with the general connector of the power housing of the board 151.

The check board further comprises a null setpoint detection circuit 125. It is connected up to a setpoint generating circuit 126; circuit 127 uses the direction of rotation information to give the setpoint the desired sign, thereby permitting control of the motor in both directions of rotation. On the board there is further disposed an emergency stop monitoring circuit 128 connected up by one of its outputs to an isolating switch control circuit 129 which is connected in turn to a circuit 130 for checking overload of the corresponding electric motors. The emergency stop command arrives via the connector 138 for the door motor. The check board carries finally a circuit 131 for monitoring the temperature of the motors.

The circuit shown in FIG. 7A further comprises a serial interface board 132 connected up to the check board 119, to the servocontrol board 156 and to the selection module 141. This board is intended to convert all the information returned to the computer 13 into serial information, and the orders coming from the computer into parallel signals. Electrical isolation is maintained between the computer and the power box of FIG. 7A. The serial interface board 132 comprises a transmitter parallel/serial interface circuit 133 which is associated with a multiplexer 134 and a receiver serial/parallel interface circuit 135 which is associated with a multiplexer 136.

The serial interface board 132 is connected up to a bus 137 through which flows the information transmitted to the computer by the selection module—the control board and the check board. Thus, the circuit 131 for monitoring the temperature of the motors is found again. The bus 137 is connected up to the input of the multiplexer 134. The serial interface board 132 comprises a supplementary input connected up to the connector passing through the connector 138 of the door motor.

The multiplexer 136 associated with the receiver serial/parallel interface is connected up to a bus 139 for linking with the connector 151 of the motor control housing 8 which will be described with reference to FIG. 7B. The interfaces 133 and 135 are connected up to a serial link 140 with the computer 13.

The part of the circuit shown in FIG. 7B principally comprises a selection module 141 which comprises a set of switches 142 connecting to the power bridge 116 that one of the electric motors 7, 11, 16 chosen by the computer 13. The switching of shaft is authorized only for a null current in the bridge and for a null setpoint so as to limit wear to the power switches.

Control of the switches is such that only one of them can be controlled at a time. This control is ensured by a control circuit 143 likewise contained in the selection module. The switches 142 are connected up to the bridge 116 via a serial inductance 144. A current detector 145 is branched between the inductance and the half-bridge 116A.

This current detector 145 is connected up to a logic circuit for managing the switching authorizations 146.

Moreover, the selection module moreover comprises a circuit 147 for control of the brakes of the reduction gear motors and for generating "brake consuming" information informing the computer that the brakes are effectively powered.

Finally, the selection module comprises a circuit for checking the selection 148.

The set of switches 142 is connected up to the connector 138 of the door motor, and to the connectors 149 and 150 of the rammer and conveyor motors. The current detector 145 sends the current measurement to the control board 156 which, after shaping, sends it to the connector 151 forming the test outlet of the housing. The circuit 143 for control of the selection switches is connected up to the bus 139 for linking with the serial interface board 132.

The authorization generating circuit 146 is connected up to the bus 124 for linking with the check board 119 and to the bus 139 for linking with the serial interface board 132. It is further connected to the null setpoint circuit 125.

The circuit 147 for control of the brakes of the reduction gear motors is connected up to the bus 139 for linking with the serial interface 132. Furthermore, it is connected to the bus 137 for linking with the inputs of the serial interface board 132. The selection checking circuit 148 is itself also connected to the bus 137.

The part of the circuit shown in FIG. 7A further comprises a power supply board 152 intended to furnish the voltages required for operation of the power housing 8. This board comprises a circuit 153 for monitoring the value ±VA of the supply voltage, a circuit 154 for copying the network voltage, and a set 155 of power supply circuits generating the various voltages required for operation of the system.

The circuit 153 is connected up to a terminal of the serial interface board 132, the circuit 154 for copying network voltage is connected up to the control board 156 which will be described subsequently, whereas the set of circuits 155 is connected up, on the one hand, to all the circuits requiring power supply and, on the other hand, to the connector 151 of the housing.

The control board 156 is intended to drive the circuits for control of the power transistors 117A, 117B and ensures servocontrolling of speed. The speed of each of the controlled motors is deduced from its back electromotive force. A current loop limits the current and improves the stability at low setpoint.

The control board principally comprises a circuit 157 for reconstituting the back electromotive force of the motor concerned. The circuit 157 is connected up to the network voltage copying circuit 154 of the power board. Furthermore, it is connected up to the connector 151 and to a summation circuit 158 branched between the circuit 127 for managing the sign of the rotation speed setpoint for the check board and a correcting circuit 159 carried by the control board. The output of the correcting circuit 159 is connected up via a summer 160 to another correcting circuit 161 whose output is in turn connected up to a circuit for generating control signals 162.

The supply of current in the motor selected is obtained by limiting the output signal from the circuit 159.

The summer 160 is further connected up to the current measuring probe 145 of the selection module as well as to a circuit for managing overloads 163, 164, 165.

The latter consists of an overload detection circuit 165 whose output is sent to the circuit 130 monitoring the motor overload and participating in the management of the control of the switch by means of the circuit 129. The reinitialization of this item of information is carried out by the circuit 163 then is transmitted to the circuit 130 for monitoring overload and to the connector 151. The value of the current is monitored by the circuit 164 the output of which is connected up to the serial interface board 132 and to the connector 151.

The circuit 162 for generating control signals is connected up to the circuit 157 for reconstituting the back electromotive force of the motors. The outputs of the circuit 162 are further connected up to a bus 166 for linking the connector 151 with the power bridge 116 or more precisely with the control circuits 118A and 118B of this bridge. An output is provided towards the connector 151.

Figure 8:
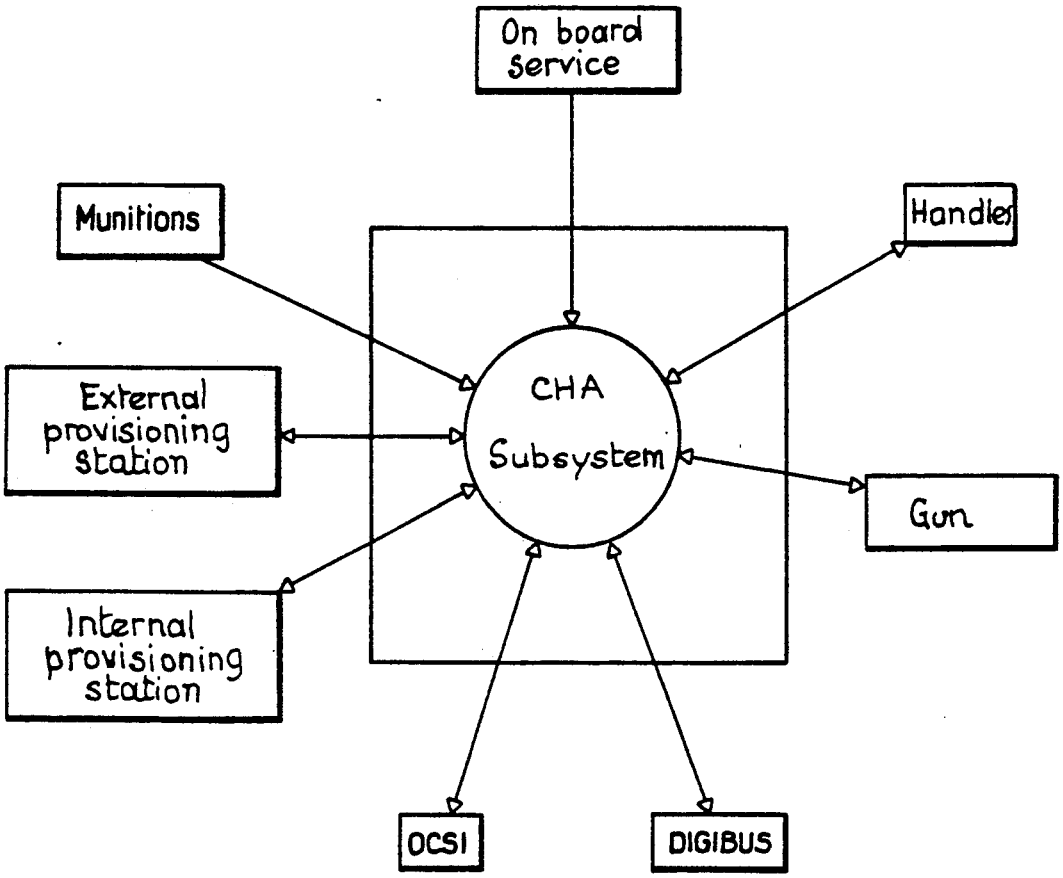
FIG. 8 is a diagram of the functional architecture of the device according to the invention.

The functional architecture of the device according to the invention described with reference to FIGS. 1 to 7B is shown by the diagram of FIG. 8.

In this figure are described functionally the interfaces between the subsystem which constitutes this device and its environment.

It is seen in FIG. 8 that, as described earlier, the subsystem is supplied with electrical energy by equipment or services on board.

The munition constitutes the object to be identified, manipulated and transferred, if required, into or out of a subsystem.

The loading subsystem is further associated with an external provisioning station which is an operator/subsystem interface permitting the provisioning and "evacuating" operations of the automatic loading subsystem or CHA, from outside the turret of the tank.

This provisioning station consists of a console for dialog with the management means and of an apparatus adapted for handling the munitions.

With the subsystem is further associated a gun which is the natural container for the munition when the latter is rammed by the rammer 9 (FIG. 1).

Handles such as the handle 23 are likewise provided to permit partial (degraded) or total (breakdown) manual operation of the subsystem.

The subsystem is moreover associated with an apparatus for control and checking of the isolated subsystem or OCSI which offers the possibility of being substituted for the DIGIBUS access mode.

DIGIBUS (see FIG. 3) is the communication network of the system of the armored vehicle, over which are made exchanges of information with the subsystem. In particular, this is the channel for guiding the loading device CHA by the fire guidance subsystem or CDT.

Finally, an external provisioning station consisting of an operator/subsystem interface 17 (FIG. 1) permits the operations of provisioning and evacuating the CHA from inside the turret. It comprises an apparatus suitable for manipulating the munitions.

There will now be described the automatic loading subsystem or CHA with reference to FIG. 9 in which the arrows show the flows of information comprising messages, commands and items of input/output I/0 information.

To fulfil its mission the CHA firstly comprises mechanical means comprising the conveyor 5 or magazine permitting storage of the munitions and introduction of a munition into the axis of ramming of the latter towards the chamber of the gun, a rammer 9 which is a device for transferring the munition from the automatic loading device to the chamber of the gun and a door 14 which isolates the CHA from the remainder of the turret.

These three functional elements are driven by the DC electric motors 7, 11, 16 (FIG. 1).

To fulfil its mission the CHA consists mechanically:

- of the conveyor 5 permitting storage and introduction of a munition into the ramming axis,
- of the rammer 9 which ensures the transfer of the munition from the CHA into the chamber of the gun,
- of the door 14 which isolates the loading device CHA from the remainder of the turret.

These three functional elements are, as indicated earlier, given by corresponding DC electric motors 7, 11 and 16.

The loading device CHA further comprises an internal/external provisioning device to permit insertion or withdrawal of munitions from the conveyor.

All these elements can be manually maneuvered.

The selection function guides the conveyor element 5 (FIG. 1).

The loading function guides the rammer element 9 (FIG. 1).

The protection function guides the door element 14 (FIG. 1).

The provisioning/evacuating function authorizes use of the internal/external manual provisioning device or DAMIE and uses the selection function to bring a cell 6 of the conveyor to the provisioning station.

The automaton management function supervises execution of the movements, produces the interface between the loading device CHA and the other subsystems, and also the OSCI dialog.

Subsequently, the functional relation existing between the CHA and the on-board services is deleted so as not to overload the diagrams.

Figure 9:
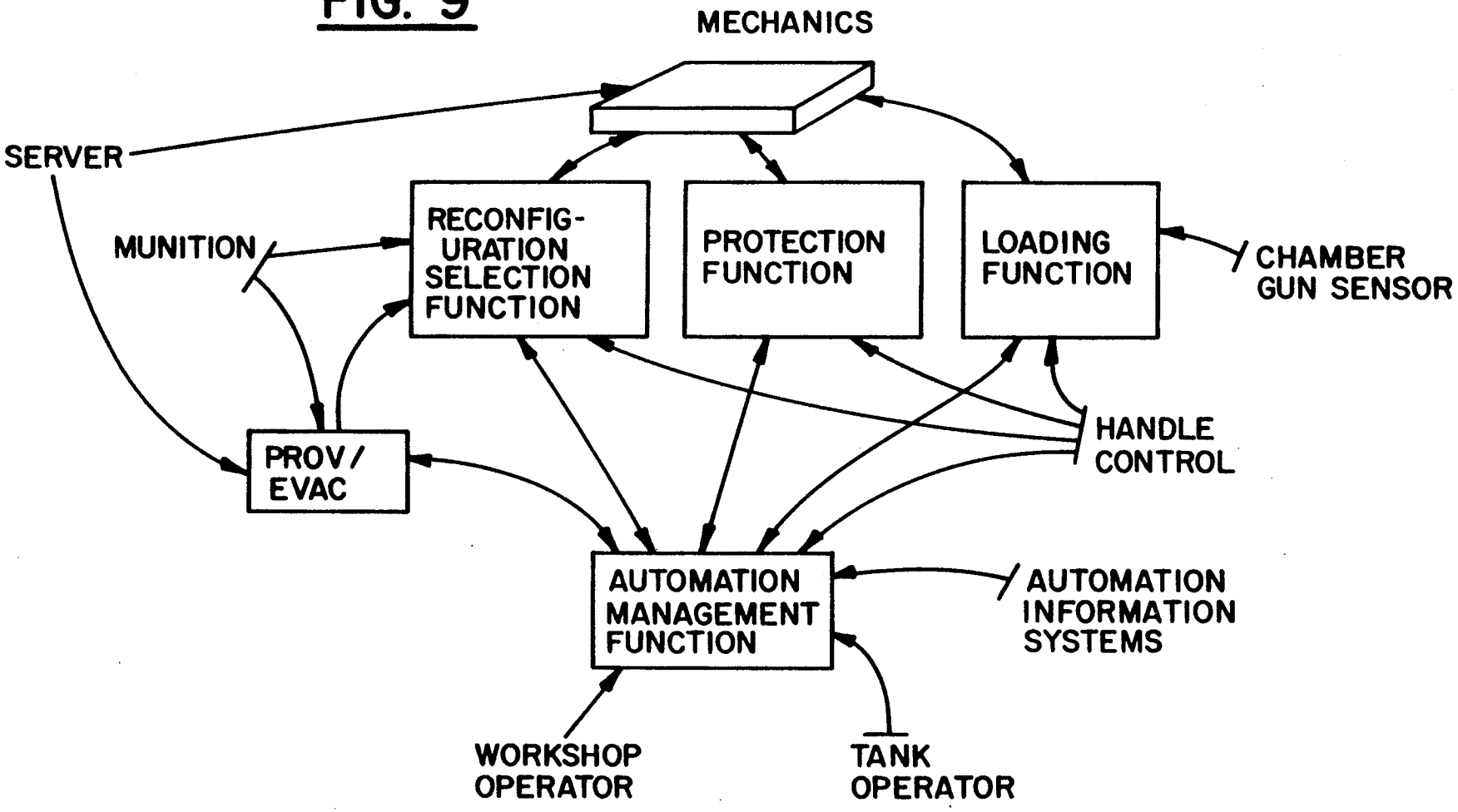
FIG. 9 is a diagram of the functional architecture of the subsystem CHA.

The other linkages are retained and remain consistent with the description which refers to FIG. 9.

In what follows, there is revealed a resource internal to the functions called DS.S (subsystem data), in which each function can exploit or update information relating to the states of degradation.

information concerning other subsystems,
indications of wear,
operating parameters,
composition of the conveyor.

Figure 10:
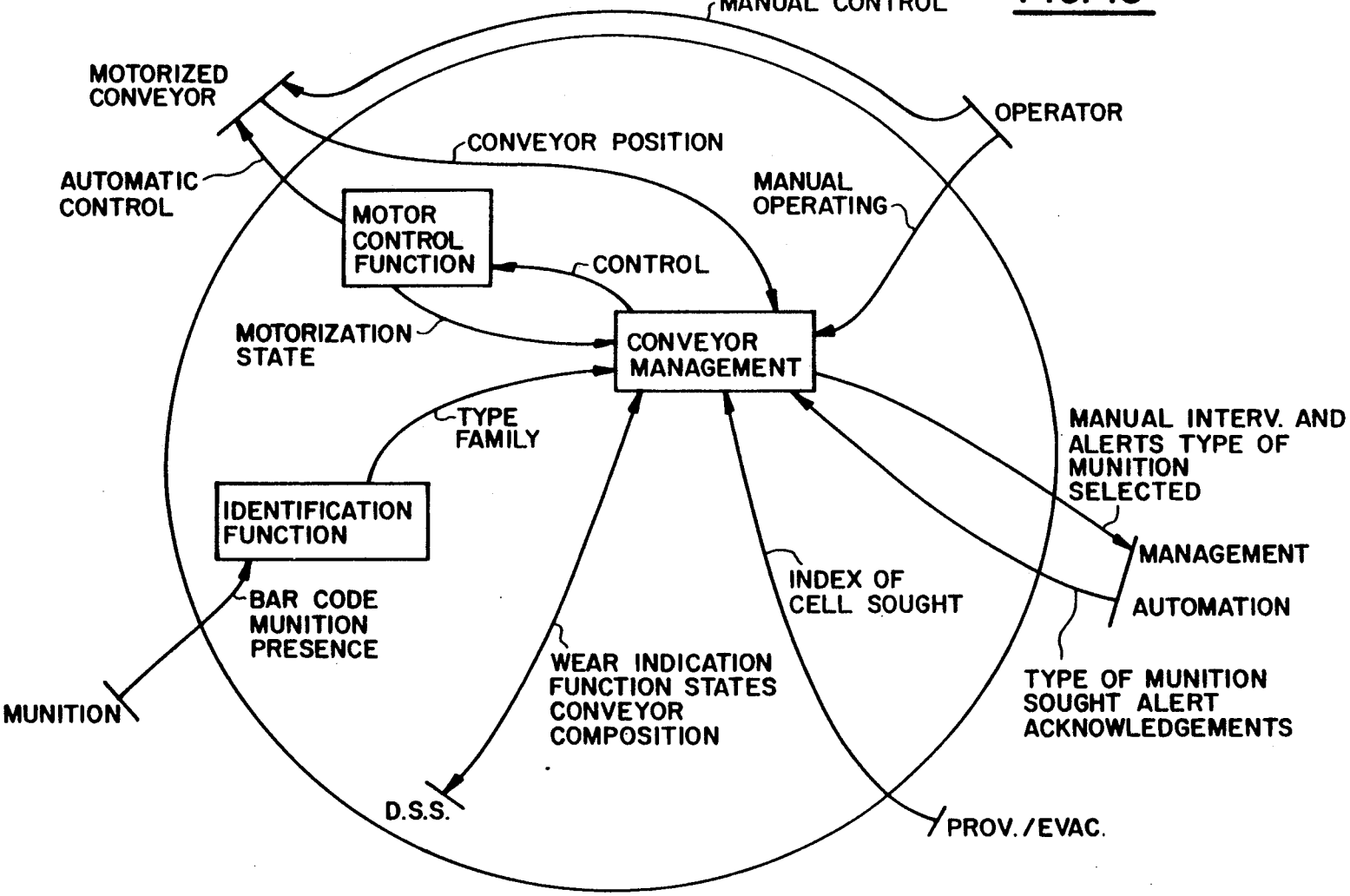
FIG. 10 is a diagram of the functional architecture of the selection function.

The selection function will now be described with reference to FIG. 10.

This function is charged with effecting the movements of the conveyor 5 which are required in selecting the munition of a given type which occupies the position closest to the ramming axis, that is to say to the rammer 9, whilst taking account of the states of degradation of the sensors 12 (FIG. 1), so as to reduce the time of selection of the munition to a minimum.

It guarantees the maintaining in position of the conveyor on stopping the cycle corresponding to the ramming axis.

The input/output information for the selection function are as follows.

As inputs, the function uses the following information:

Presence of munition in the loading station.
Munition bar code (type and family).
Index of the cell sought.
Type of munition sought.
Manual operating.
Absolute position of the conveyor.
Selection/reconfiguration order.
State of the brake.

As outputs, it formulates the setpoints for powering and braking of the DC motor 7 which equips the conveyor 5. It indicates the type of munition selected in the loading station.

The selection of the munitions is carried out as follows:

The function receives a selection order from the management automaton, with the type parameter. It computes, relative to the current position of the conveyor 5, how many steps and in what direction it must rotate in order to bring the requested munition into the ramming axis in the minimum time.

The cell selection is carried out in the following way:

The function receives a selection order from the provisioning/evacuating function with the "No. of the cell requested" parameter. It proceeds to evaluate, relative to the current position of the conveyor, the number of steps and the direction of rotation which permit the relevant cell to be brought to the provisioning/evacuating station with the minimum delay.

Reconfiguration of the magazine is likewise ensured by the selection function.

On request by the management automaton, the function effects a complete rotation of the conveyor so that each cell 6 passes under the various munition identification sensors. The readings are made on the move (synchronization in the stoppage of the cycle). The set of readings is analyzed so as to build up, with maximum certainty, the actual contents of the magazine.

The selection (software) algorithms take account of the state of degradation of the sensors so as to minimize the selection time whilst guaranteeing the bringing of a munition into the ramming axis.

The identification sensors, 30, 31 and the munition presence sensor 26*a* (FIG. 2) permit reconfiguration of the magazine if at least one of them is operating. Sensors make it possible to guarantee the presence of a munition in a cell 6. The selection guarantees the bringing of a munition into the ramming axis whilst minimizing the cycle in the event of degradation of one of them. Just one of them operating permits selection.

The selection function can be issued in breakdown mode. In this case, the algorithm requests an arm-controlled maneuver (manual rotation) by the operator, indicating to him the direction of rotation and the number of steps to make to bring the munition to the desired place. The automatic unit verifies acknowledgement of the operator insofar as its position sensor is operating. It repeats its request if necessary, taking account of the new conditions (current position of the conveyor).

Insofar as reconfiguration is impossible, the automatic loading is placed in a breakdown condition. Test orders alone can be executed.

The redundancy of the sensors can, during a reconfiguration, involve a conflict which does not permit identification of the contents of a cell. Because of this, reconfiguration may end up at a magazine which is partially exploitable owing to the existence and the certain knowledge of the contents of a few cells. The other munitions are classified as unknown and are operated by the positioning/evacuating function. It is impossible to select a munition of this type at the loading station, namely, at the ramming position.

Any unidentified munition cannot be loaded.

Figure 11:
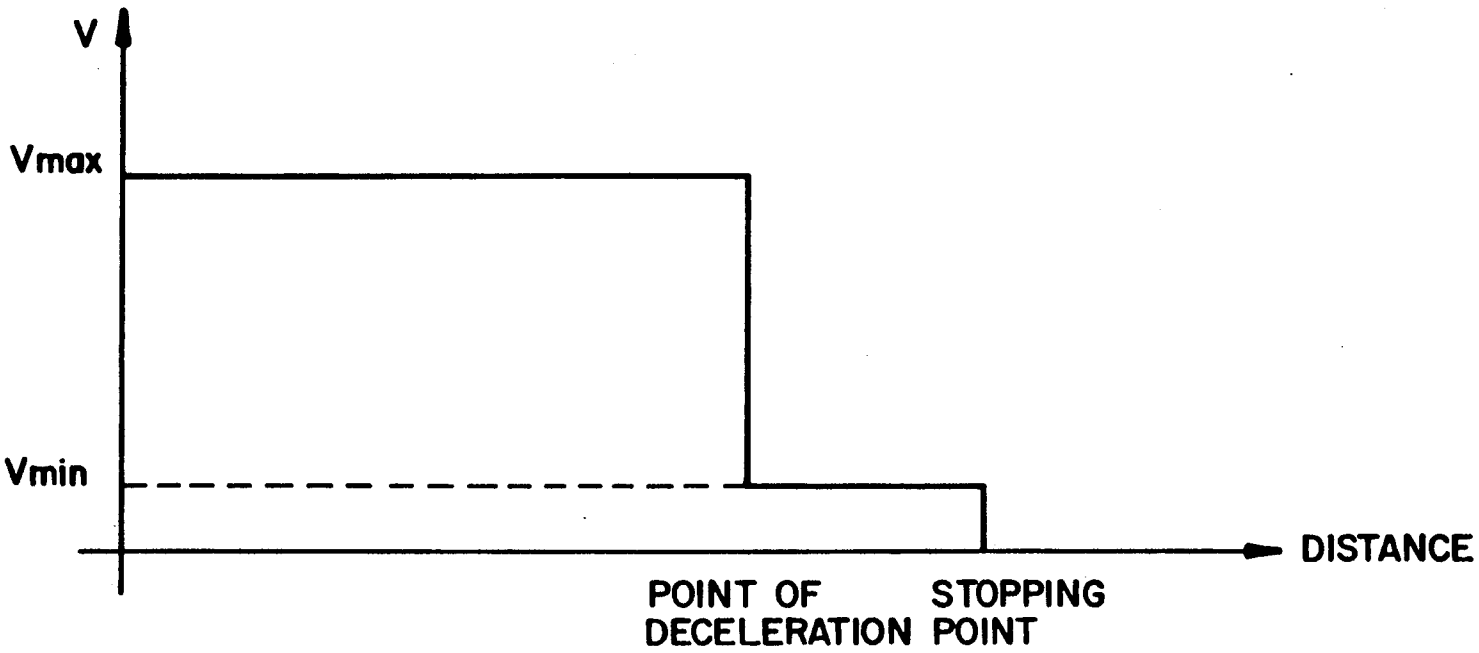
FIG. 11 is a graph of the positioning of the speed, at three levels, utilized by the device according to the invention.

The speed setpoint described in FIG. 11 is an all-or-nothing positioning with three speed levels.

Maximum speed (non-regulated speed): this is applied so long as the point of deceleration has not been reached or exceeded.

Minimum speed (regulated speed): this is applied between the point of deceleration and the stopping point. This phase permits the slowing of the rotation of the conveyor. The deceleration distance is evaluated so as to permit the selection function to attain, under extreme conditions in the overall field, the speed of rotation Vmin before the stopping point.

Null speed: this is the stopping speed.

This is applied once the stopping point has been reached or exceeded. The stopping distance is evaluated so as to guarantee the stopping precision discussed earlier.

The speed servocontrol of the conveyor guarantees that the evolution in position during the gripping of the brake is sufficiently slow to ensure the precision of the positioning.

Because the speed of rotation Vmax is not servo-controlled, its value is related to the voltage of the on-board network. The algorithm for synchronizing reading of the identification sensors 12 takes account of these constraints, the global field included.

The movements of the conveyor 5 are interrupted if the environment of the selection function is not such that the security of the subsystem would be guaranteed.

The selection function has available means enabling it to diagnose as far as possible the elements likely to be the cause of its poor operation. Clearly, one of its functional elements is involved. During maintenance, it offers the possibility of finding out the electrical state of these inputs/outputs.

Figure 12:
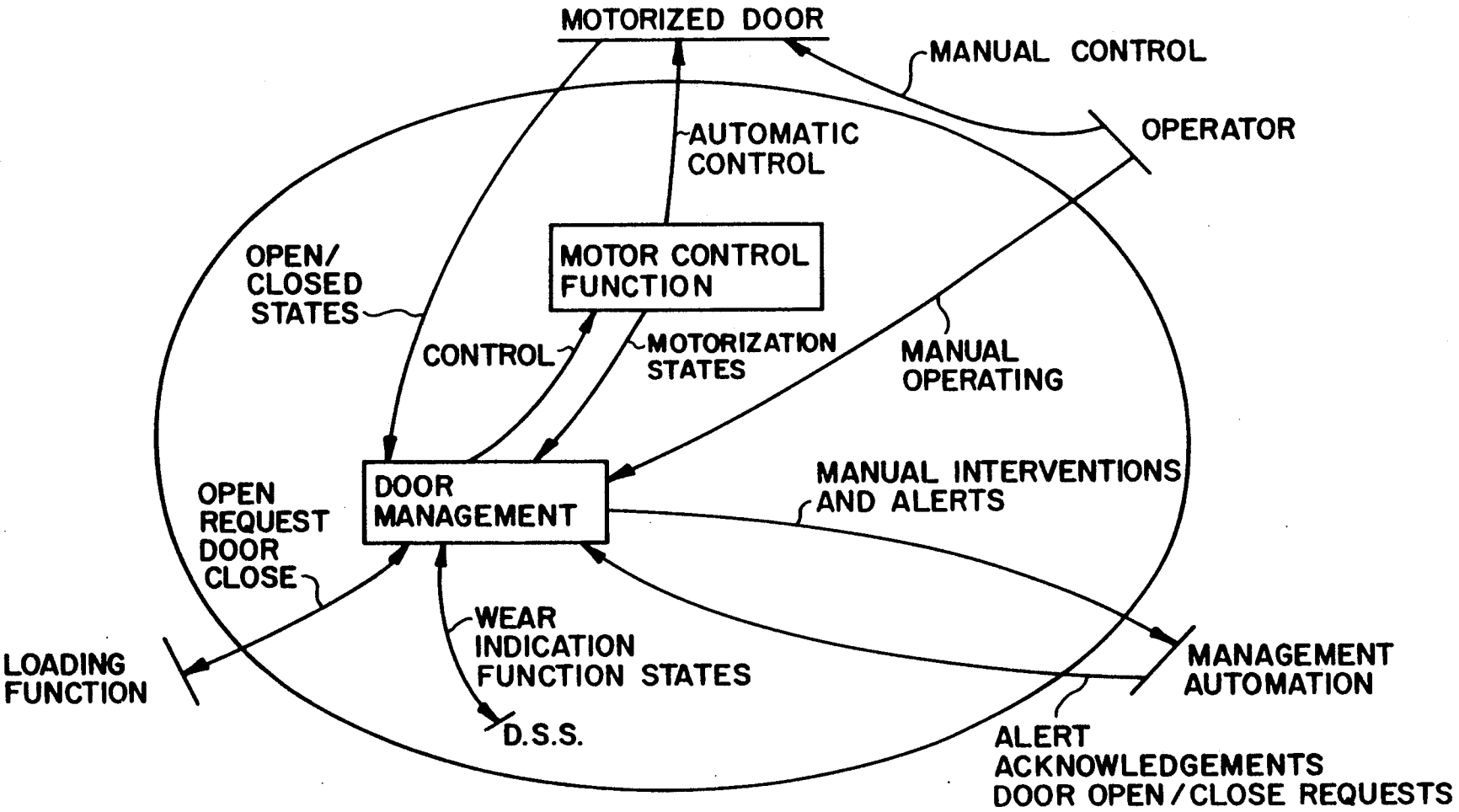
FIG. 12 is a diagram of the functional architecture of the protection function of the device according to the invention.

The role of the protection function which will now be described with reference to FIG. 12 is to ensure the separation between the pocket in which the CHA is placed, and the remainder of the turret of the tank in which, in particular, the operators are accommodated.

It guarantees maintenance of the door 14 (FIG. 1) in the closed position or, in the case of a ramming, in the open position.

The input/output information for this function is the following.

Open door state.
Closed door state.
Manual operating.
Opening/closing order.
State of the brake.

As outputs:

It formulates the setpoints for powering and braking of the DC motor which equips the door.

The algorithm consists in applying simply the maximum setpoint until the state of the corresponding sensor (open or closed) conforms with the requested order, or for a fixed duration through the normal operating of this function (temporization). It is an all-or-nothing control.

If the function is impossible to execute, the algorithm calls upon an arm-controlled maneuver by the operator in order to effect the opening or closing. The automatic unit verifies acknowledgement by the operator and in consequence degrades its sensors.

The movements of the door 14 are interrupted if the environment of the protection function is not such that the security of the subsystem would be guaranteed.

The protection function has available means enabling it to diagnose as far as possible the elements likely to be the cause of its poor operation. Clearly, one of its functional elements is involved. During maintenance, it offers the possibility of finding out the electrical state of these inputs/outputs.

Figure 13:
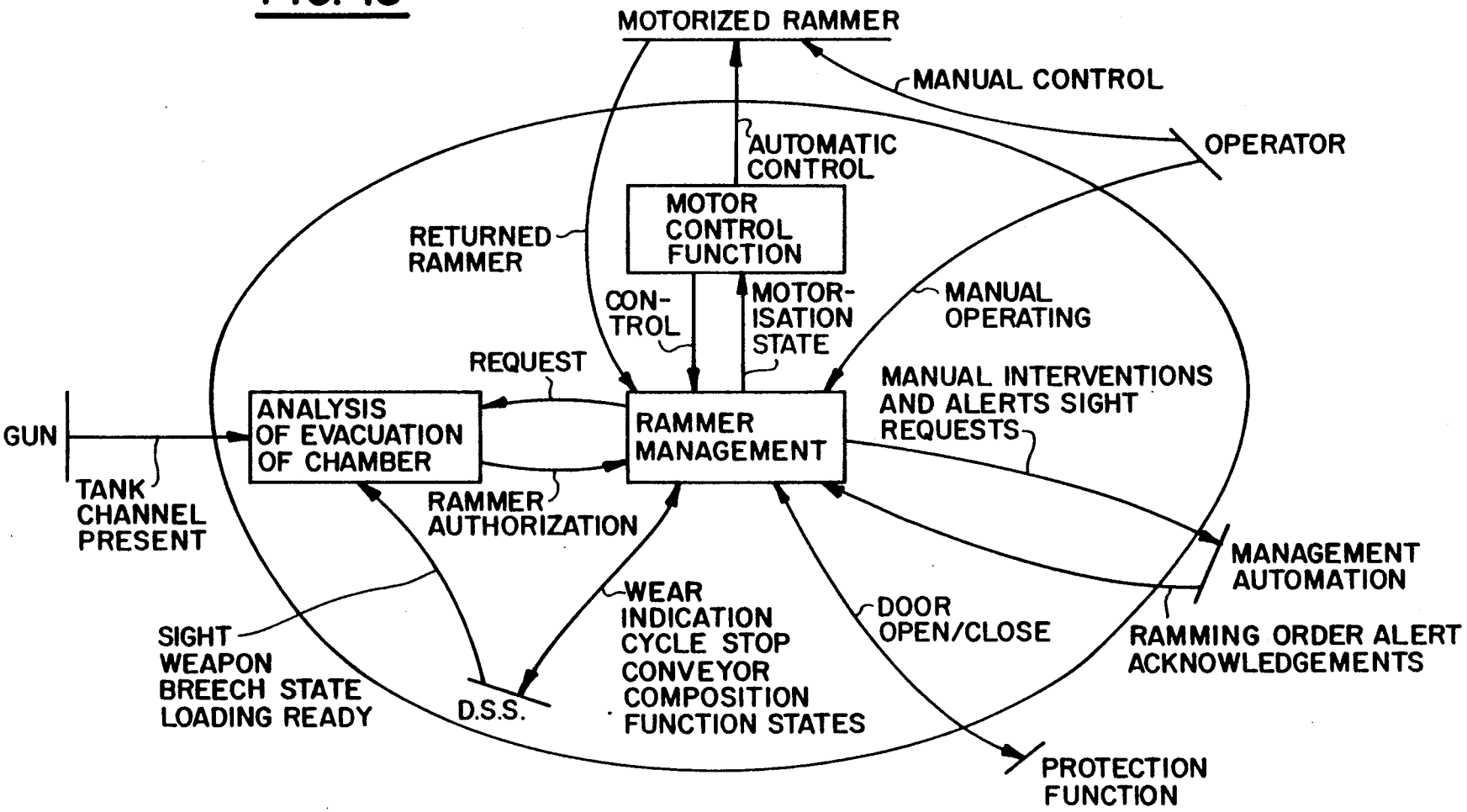
FIG. 13 is a flow diagram of the loading function of the device according to the invention.

The loading function of the device is shown by the functional diagram of FIG. 13.

It ensures the transfer of a munition situated in the ramming axis of the magazine towards the chamber of the gun.

It maintains the munition in the chamber until the breech chock of the gun comes back. It guarantees the maintaining of the rammer 9 (FIG. 1) in the returned position.

The input/output information from the loading function are the following:

As inputs:

An item of breech information.
An item of weapon sighting information.
An item of ready for loading information.
State of chamber evacuation.
Ramming order.
Returned rammer state.
Open door state.
State of minimum current consumption.
Manual operating.
State of cycle stoppage (ramming window).
State of the brake.

As outputs:

It formulates the setpoints for supplying and for braking of the DC motor 11 which equips the rammer 9.

It indicates the type of munition rammed into the gun and the resulting composition of the conveyor.

The ramming cycle breaks down into several phases which generally follow the step for selecting a munition.

Once the weapon is ready for loading (free for the ramming), then at the loading site, the function analyzes the state of evacuation of the loading channel (weapon/CHA interface) and:

Requests the protection function to open the door 14.

Executes the output from the rammer (transfer of the munition).

Executes the standby and the correlating of the breech state and consumption state information. These indicate whether the ramming has been executed.

Executes the return of the rammer, and thereby the locking onto site.

Requests the protection function to close the door.

If the input and output operations cannot be executed by the automatic unit, either because the function has broken down, or in order to guarantee the security of the subsystem, the algorithm must ensure transfer to manual via the operator. During the acknowledgements, the verification of the sensors is proceeded If the channel is not free (empty) or if the associated sensor is degraded, the algorithm performs, via the operator (in manual mode), the evacuating of the latter.

When the munition is completely inserted into the gun, it leaves the way free for the breech chock.

The ARME subsystem indicates this fact to the CHA by the "breech not open" state. If this item of information does not appear within a period of one second whilst the item of information relating to the maximum current is present and whilst the ramming period is complete, the function interrupts its automatic cycle, blocks the position of the rammer in the current state and proceeds to terminate its manual cycle.

The outgoing movement of the rammer 9 is interrupted if the SIGHT and BREECH state information no longer conform.

The movements of the rammer are interrupted if the environment of the loading function is not such that the security of the subsystem would be guaranteed.

The loading function has available means enabling it to diagnose as far as possible the elements likely to be the cause of its poor operation. Clearly, one of its functional elements is involved. During maintenance, the loading function offers the possibility of finding out the electrical state of these inputs/outputs.

Figure 14:
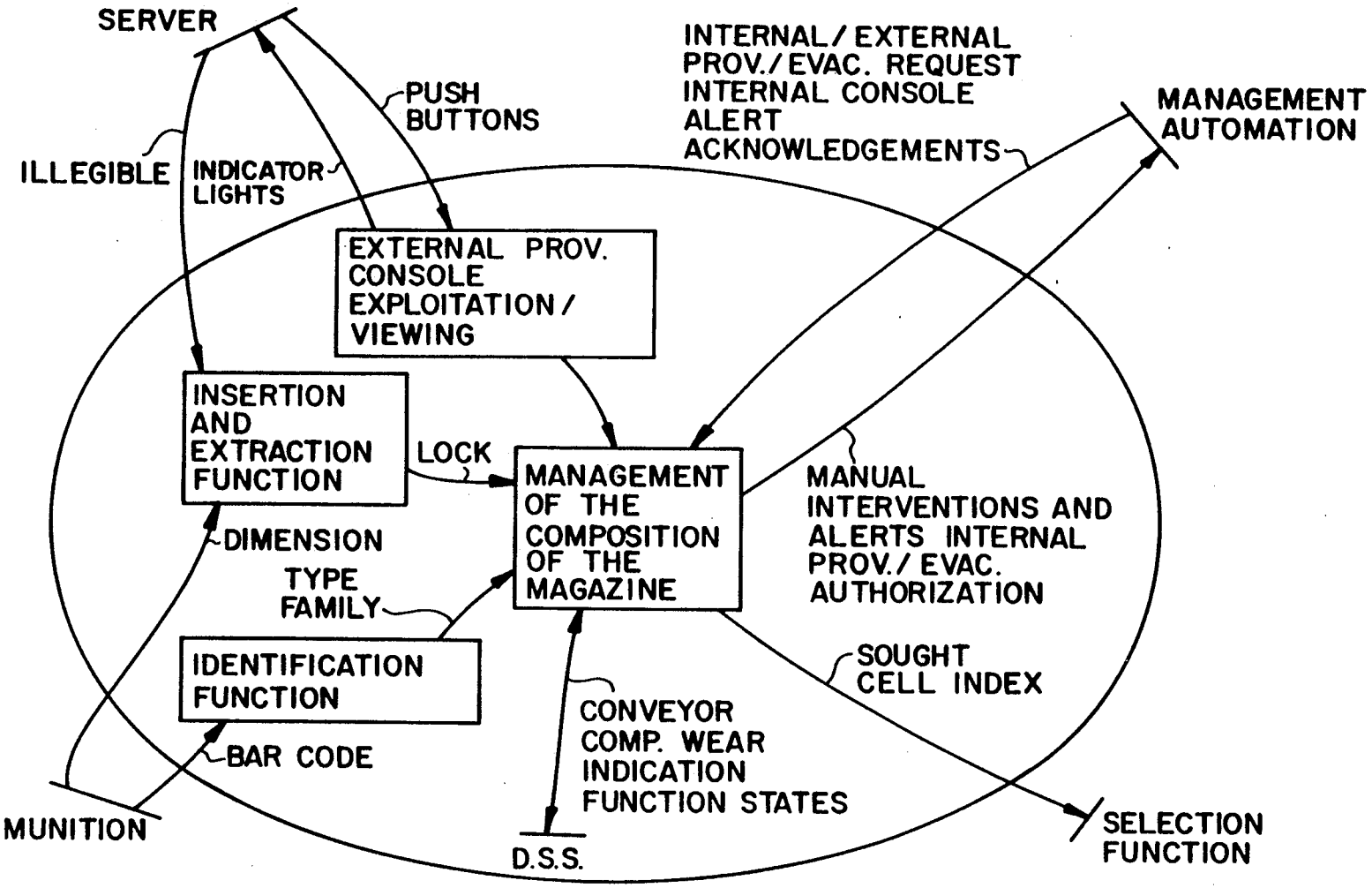
FIG. 14 is a flow diagram representing the provisioning/evacuating function of the device according to the invention.

The provisioning/evacuating function is represented by the flow diagram of FIG. 14.

It permits provisioning of the magazine with munitions when certain of the cells 6 of the magazine are empty or emptying of the magazine selectively.

The input/output information for this function are the following:

As inputs:

External provisioning housing (B.P)
Internal provisioning information (DIGIBUS).
Internal/external apparatus state.
Bar code (type/family).
Provisioning/evacuating order.

As outputs:

No. of cell sought.
External provisioning housing (indicator light).
Internal provisioning information (DIGIBUS).
Conveyor composition or munition load state of the magazine.

The provisioning sequence divides up into several steps as follows:

Search for the empty cell closest to the provisioning station.

Requests the selection function to bring the relevant cell to the provisioning station.

Indicate to the operator the authorization to provision.

The operator unlocks and extracts his provisioning apparatus.

Places a munition in the empty cell.

Replaces and locks his provisioning apparatus.

Validates the end of his maneuver,

The function proceeds to identify automatically the bar code of the munition, and to update the composition of the conveyor.

This procedure continues until the operator indicates that the provisioning operation has terminated or that the conveyor is full.

The particular cases are described later.

The evacuating sequence also divides up into several steps:

The operator indicates the type of munition to be evacuated.

Search for the cell containing the relevant type closest to the provisioning station.

Requests the selection function to bring the relevant cell to the provisioning station.

Indicate to the operator the authorization to evacuate.

The operator unlocks and extracts his provisioning apparatus.

Withdraws the munition present in the cell.

Replaces and locks his provisioning apparatus.

Validates the end of his maneuver.

The function proceeds to a verification of the cell (normally empty) and updates the composition of the conveyor.

This procedure is repeated so long as the operator does not indicate the end of the evacuating operation or the conveyor is not empty.

The particular cases are described later.

The two identification sensors 12 permit mutual autochecking. In the case of degradation of one of them, automatic identification is still ensured by the one in operation.

If the bar code present on a munition cannot be exploited (erased or erroneous code), the function requests the operator to specify the type of the munition provisioned.

When an empty cell 6 is damaged, the operator, during a provisioning, can rule it out in such a way that it is no longer presented to him by the function (it is ruled back in at the end of the provisioning sequence).

The provisioning/evacuating function ensures a certain number of particular operations.

It permits an automatic identification of the munitions.

By taking into account the state of degradation of its sensors, the function evaluates the path which it should take to identify a munition and to be assured of its presence or of its absence. It calls upon the selection function to bring the cell involved to the various provisioning and loading stations, and under the identifiers.

It likewise permits a manual identification.

The munitions identified manually are managed in the same way as the munitions identified automatically, which makes it possible to have munitions with or without bar code in one conveyor.

However, the codes are protected of these munitions not being able to permit a reconfiguration.

If, at the start of the evacuating sequence, the function detects the existence in the conveyor of a munition of whose code it is ignorant, it proceeds to reject it immediately (forced evacuation) before executing the operating orders.

The provisioning/evacuating function has available means enabling it to diagnose as far as possible the elements likely to be the cause of its poor operation. Clearly, one of its functional elements is involved. During maintenance, it offers the possibility of finding out the electrical state of these inputs/outputs.

Figure 15:
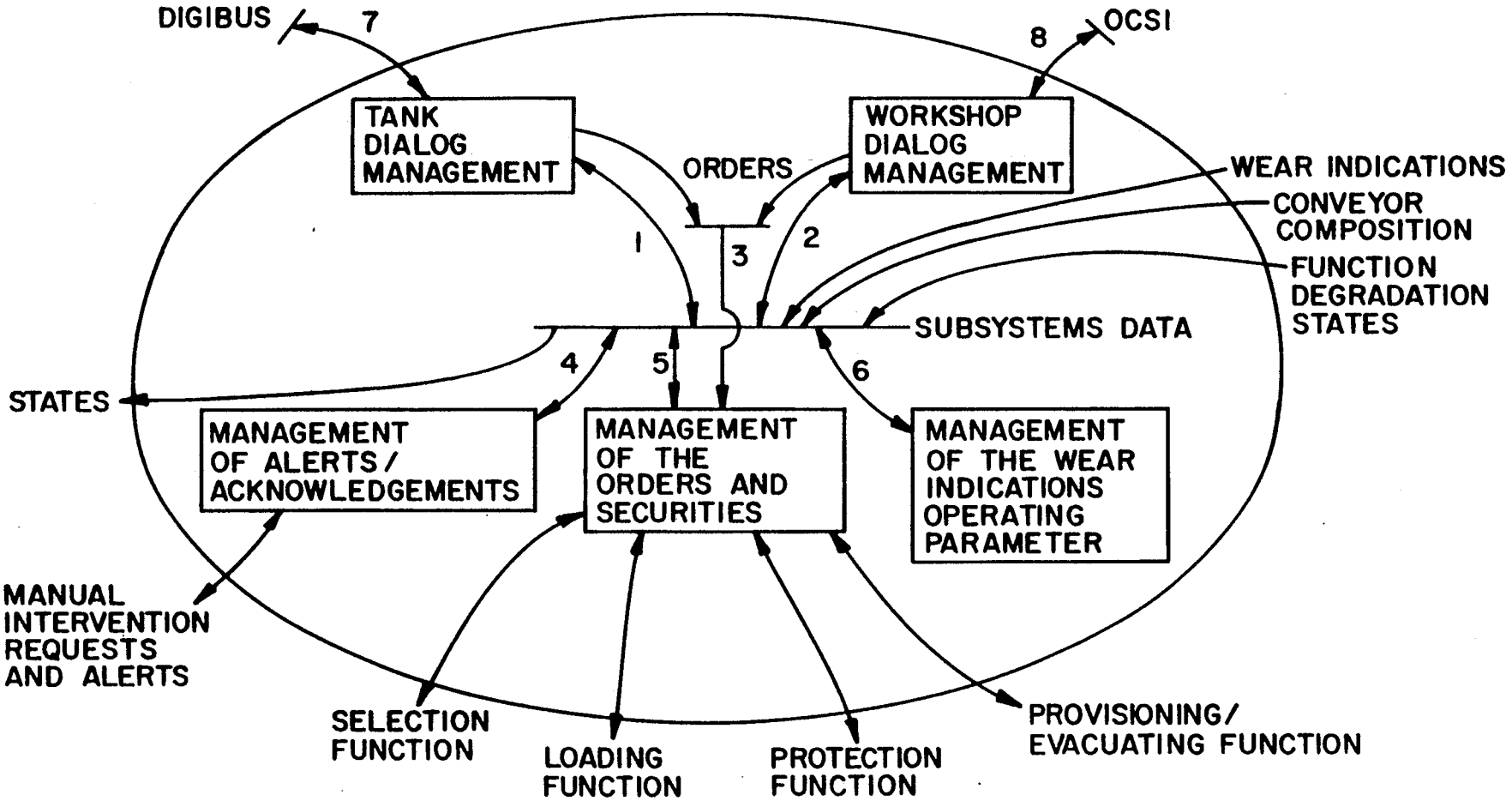
FIG. 15 is a flow diagram representing the automaton function for management of the device according to the invention.

The automaton management function is shown in the diagram of FIG. 15.

This function ensures the following principal processing operations:

Management of the DIGIBUS dialog interface.

It ensures the logical and physical transfer of information from the CHA to the other subsystems, in particular to the fire guidance. In the same way it ensures the transfer and the processing of all the information from the other subsystems which condition the operation of the CHA.

Management of the OCSI dialog interface.

Taken in isolation, the CHA can be employed in the absence of a DIGIBUS. This interface ensures the management of an alphanumeric terminal with touch-sensitive screen. In particular, it performs the menu management, presentation thereof, as well as the formatting of various items of information which are of interest to the operator.

Management of alerts and acknowledgement.

It consists in processing the alerts following faults which the other functions have detected (degradations) and in verifying the acknowledgements of the operators following the manual interventions solicited by the other functions.

Management of the orders and security.

It ensures the consistency of the orders and their execution depending on the current condition of the CHA. It is charged with guaranteeing the security of the personnel (processing of emergency stops).

The orders, after filtering, are transmitted to the other functions. It ensures the passage from one mode to another.

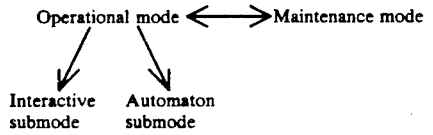

It supervises the starting up and stopping of the subsystem.

Management of the protected information.

The management of this information consists in preserving the validity thereof under any circumstances, in particular on start-up and stopping of the subsystem.

There are two types:

The operating parameters.

The absolute origin of the conveyor.

The composition of the conveyor.

This information makes it possible to be rapidly operative. They are, therefore, vital.

The indications of wear.

This involves counters made available to the maintenance technician, since these indications are characteristic of hardware fatigue.

This information is not useful in the operation and, therefore, does not affect the availability of the CHA.

The input/output information for the automaton management function are the following:

Flow of information No. 1 (see FIG. 15).
As input:
Parameters associated with the orders:
Munition type.
Test type.
AE subsystem state.
SERVOCONTROL subsystem state.
MEANS OF INSTRUCTION AND OF MAINTENANCE sub-system state.
Alert acknowledgements:
Conveyor positioned.
Rammer positioned.
Door positioned.
apparatus locked.
Gun chamber empty.
End of manual operating.
Emergency stop withdrawn.
Technical information.
Indications of wear (initial values).
As outputs:
Execution report — Current state, Munition type, Cell No., Physical state of the I/O.
Faults.
States of degradation.
Operator alerts.
Technical information.
Sight request.
Flow of information No. 2 (see FIG. 15)
As input:
Parameters associated with the orders:
Munition type.
Test type.
ARME subsystem state.
SERVOCONTROL subsystem state.
MEANS OF INSTRUCTION AND OF MAINTENANCE subsystem state.
Alert acknowledgements:
Conveyor positioned.
Rammer positioned.
Door positioned.
apparatus locked.
Gun chamber empty.
End of manual operating.
Emergency stop withdrawn.
Technical information.
Indications of wear (initial values).
Setting:
of the state of the functional elements,
of the value of the I/Os.
As outputs:
Execution report — Current state, Munition type, Cell No., Physical state of the I/O
Faults.
States of degradation.
Operator alerts.
Technical information.
Sight request.
Logic values of the I/Os
Flow of information No. 3 (see FIG. 15)
As input:
It involves the orders:
lookout,
selection,
loading,
test,
provisioning.

-continued evacuation.

As regards the test type, there are tests specific to the maintenance by the OCSI channel which are not useful to the DIGIBUS channel. This involves elementary movements.

Flow of information No. 4 (see FIG. 15)
As input:
Operational alerts:
Request for manual intervention
conveyor positioning.
door positioning.
rammer positioning.
locking of the apparatus.
positioning of the cell 1 to the provisioning station.
Weapon not empty
Emergency stop triggered
Automaton moding progress
As outout:
Acknowledgement of the alerts:
conveyor positioned.
door positioned.
rammer positioned
apparatus locked.
end of manual operating.
weapon empty.
emergency stop withdrawn.
Flow of information No. 5 (see FIG. 15)
As input:
Execution report.
sequence in progress,
sequence anomaly.
Cancellation of sequence.
Emergency stop.
Mode in progress.
Authorization of movement.
As output:
State of degradation of the functions.
Current mechanical states:
conveyor,
door,
rammer,
apparatus,
handle.
Flow of information No. 6 (see FIG. 15)
As input:
Data present in permanent memory
As output:
Data to be saved in permanent memory.
Flow of information No. 7 (see FIG. 15)
This flow of information travels towards the DIGIBUS coupler board 51 and the link 60 (FIG. 3).
As input:
Messages emitted by the fire guidance.
transfer command
track command
test command
service message
short cycle No.
message for control of the CHA
Messages for acquisition of the armed subsystem.
Messages of mode of the servocontrol subsystem.
Technical messages for the subsystem means of instruction and of maintenance.
As output:
CHA subsystem mode message.
CHA subsystem state message.
CHA subsystem technical message.
Test message (test command).
Flow of information No. 8 (see FIG. 15)
This flow of information travels across the central processing unit board 56 through the circuits 74 and 75 of FIG. 4.
As input:
Key code (touch-sensitive screen).
Weapon code.

-continued

| |
|---|
| Presence of the OCSI housing. |
| As output: |
| CHA subsystem mode message. |
| CHA subsystem state message. |
| CHA subsystem technical message. |
| Operator and viewing menu. |
| Watchdog indicator light. |

Guidance of the CHA can be performed by the DIGIBUS and OCSI channels separately, in the knowledge that the presence of the latter on powering up implies the impossibility of using the former.

DIGIBUS channel.

The CHA is a subscriber to DIGIBUS.

Reception of the messages is regulated by the BUS manager. Because of the repetition of the same message at regular intervals, the subsystem reacts only to variations in the message between two periods.

Each new message is decoded and its information is translated into data which can be exploited by all the functions.

On transmission, the message is formatted then updated in the exchange zone of the DIGIBUS coupler. The fetching is also regulated by the bus manager.

OCSI channel.

The operator has available menus scrolling on the touch-sensitive screen. He can transmit orders, view, modify subsystem data, call up/execute a program, check the chaining of menus and read state messages which appear in the streamline. Management of the screen is achieved taking into account the character strings called up and the current operation of the CHA. The information related to the ARME also travels through the same channel. It refers to the state of the breech and of the loading site.

Supervision of the subsystem.

This supervision ensures the following procedures:

| |
|---|
| Procedure for managing the orders. |
| It manages reception of the orders. |
| It conditions their execution. |
| It checks the consistency of the mechanical state. |
| It transmits the order to the functions responsible for exploiting it: |
| SELECTION function, |
| LOADING function, |
| PROTECTION function, |
| PROVISIONING/EVACUATING function |

It manages the watchdogs for the subsystem whose role is to guarantee its security in the event of anomalous operation.

If necessary, it cancels the order in progress.

Procedure for managing the acknowledgements.

It constructs the messages which are transmitted to the procedures for DIGIBUS and OCSI dialog and manages the acknowledgements. In this case, the function transmitting a request for intervention is placed on standby for this acknowledgement. This standby may or may not be interrupted by a change of order. Once the acknowledgement is received, the function returns to its suspended processing operation.

Procedure for management of the permanent memory (memory board 52—FIG. 3).

On powering-up, this procedure is charged with recovering the information or operating parameters which are useful or necessary to the CHA, in particular:

The coder origin, since this conditions the positioning of the conveyor on stopping the cycle.

The composition of the conveyor since consistency thereof permits the selection of a munition within the shortest period of time.

The indicators (pilots) of wear.

When the on-board network disappears or the CHA is placed in the breakdown state, these data are placed in the permanent memory of the subsystem.

A few remarks will now be set out related to performance of the processing operations and operating conditions.

DIGIBUS processing: the time for processing the DIGIBUS information is in all cases strictly less than 100 ms.

The procedure which manages it guarantees that all the messages of interest to the CHA are taken into account, in particular when these messages arrive within the same period of the DIGIBUS frame, with the knowledge that this condition can at worst arise every 100 ms.

When DIGIBUS sends an order, the CHA indicates to the CDT that the latter is acquired within a period less than or equal to 100 ms. However, there exists for the CHA a time of implementation of this order which depends on its environment.

If the subsystem is on standby and in a consistent mechanical state, the execution time is less than or equal to 200 ms.

If the subsystem is in the process of executing an order, the reaction time is related to the cancellation context; it is, however, less than or equal to 3 s.

If the subsystem is in an inconsistent mechanical state, the delay period is related to the operator charged with resetting the CHA to a conforming state before any order is executed.

OCSI processing.

The ARME information which travels through the OCSI housing is processed in a time less than or equal to 20 ms. The time of transfer from the OCSI housing to the computer 13 is less than or equal to 10 ms.

Emergency stop.

The response time of the subsystem following an emergency stop punch action is less than or equal to 150 ms. This time guarantees stoppage of mechanical movement.

The report of the subsystem for the attention of the operator is less than or equal to 1 s.

Initialization time.

Insofar as the mechanical state of the CHA on powering-up does not require the aid of the operator (manual action), complete initialization including testing, up to the order standby phase, is less than or equal to 5 s.

Stopping time.

This depends on the technologies employed. The one adopted for the CHA guarantees a saving in 10 ms.

The availability and the degraded operation of the automaton management function will now be considered.

Mechanical state.

The execution of an order is delayed if the mechanical state of the subsystem is not known.

The function proceeds, before the execution of the order, to a prior mechanical initialization.

Manual operating.

Manual operating by the operator predominates over the automatic unit. If a handle is engaged during an operation, the latter is suspended. Stoppage of the operation is immediate if it is the conveyor which is moving. In the case of a movement of the rammer or of the door, stoppage of the operation takes place at the end of the movement in progress.

Once manual operating has disappeared, the suspended operation takes over again after an initialization phase such as described above and if no new order has been issued by the fire guidance.

Emergency stop.

The emergency stop arising from anomalous software is distinguished from that arising from the punching of the emergency stop.

The software emergency stop leads, whatever the state of the CHA, to a blocking condition which prohibits all exchanges with the outside; only powering up again can extract it therefrom, The hardware emergency stop proceeds in the same way as for the taking of manual responsibility.

Operating parameter.

Loss of the coder origin leads to a complete unavailability of the CHA as regards its operational mission. However, this condition does not prohibit the internal tests which do not involve movement.

Loss of the conveyor composition leads the selection function to perform a reconfiguration which increases the time of execution of the selection order. If this ends up with an impossible reconfiguration owing to the degradation of the permanent memory, the subsystem indicates that it is inoperative, which means that it cannot fulfil its operational mission. However, this condition does not prohibit any internal test.

The particular operations of the function are the following:

The hand controls.

If the operator engages the hand controls without having been invited to do so by the CHA, the automaton function causes in consequence:

a sequence cancellation, a blocking of the orders, a blocking of the mechanical movements, until the operator explicitly indicates the end of his manual maneuver.

Powering off and on.

The function proceeds to powering-up to a static internal autotest (without mechanical movement) which makes it possible to inform the operator of the state of availability thereof. The function proceeds to the initializing of the subsystem dialog, in particular to the transfer of information from its permanent memory towards the fire guidance. It performs the mechanical initializing of the functions and places itself in an order standby state.

On the disappearance of the on-board network, the function implements an operation for saving the vital information in the permanent memory and evaluates the signature which guarantees the consistency of this information when powering up again.

Battery monitoring.

The presence of this item of information from the subsystem OF MEANS OF INSTRUCTION AND OF MAINTENANCE involves the function in a procedure for locking the mechanical movements. No order can be executed. No indicator light comes on until the disappearance of this item of information.

DIGIBUS connection/disconnection.

Dialog is possible only when the subsystem is connected up.

Bus silence.

When the subsystem is connected up as indicated above, the function monitors the periodic evolution of the short cycle No. (NCC) which crosses on the DIGIBUS frame every 10 ms. The absence of a message or non-evolution of the short cycle number for eleven cycles at 100 Hz characterizes a "bus silence" and in this case the function adopts an automaton mode of operation. In contrast to an interactive function mode via DIGIBUS or OCSI, the automaton mode entails the guiding of the CHA through an external provisioning housing with the sole purpose of implementing an external provisioning/evacuating operation carried out by the function of the same name. In this mode, the Dialog is reduced; no degraded operation is possible. The subsystem exits this state as soon as the fire guidance reconnects the CHA to the DIGIBUS and if no provisioning or evacuating order is in progress.

Bus error.

The function is charged with monitoring the transmission errors in the DIGIBUS exchanges. It informs the operator as to the number of errors which it detects in each minute.

Figure 16:
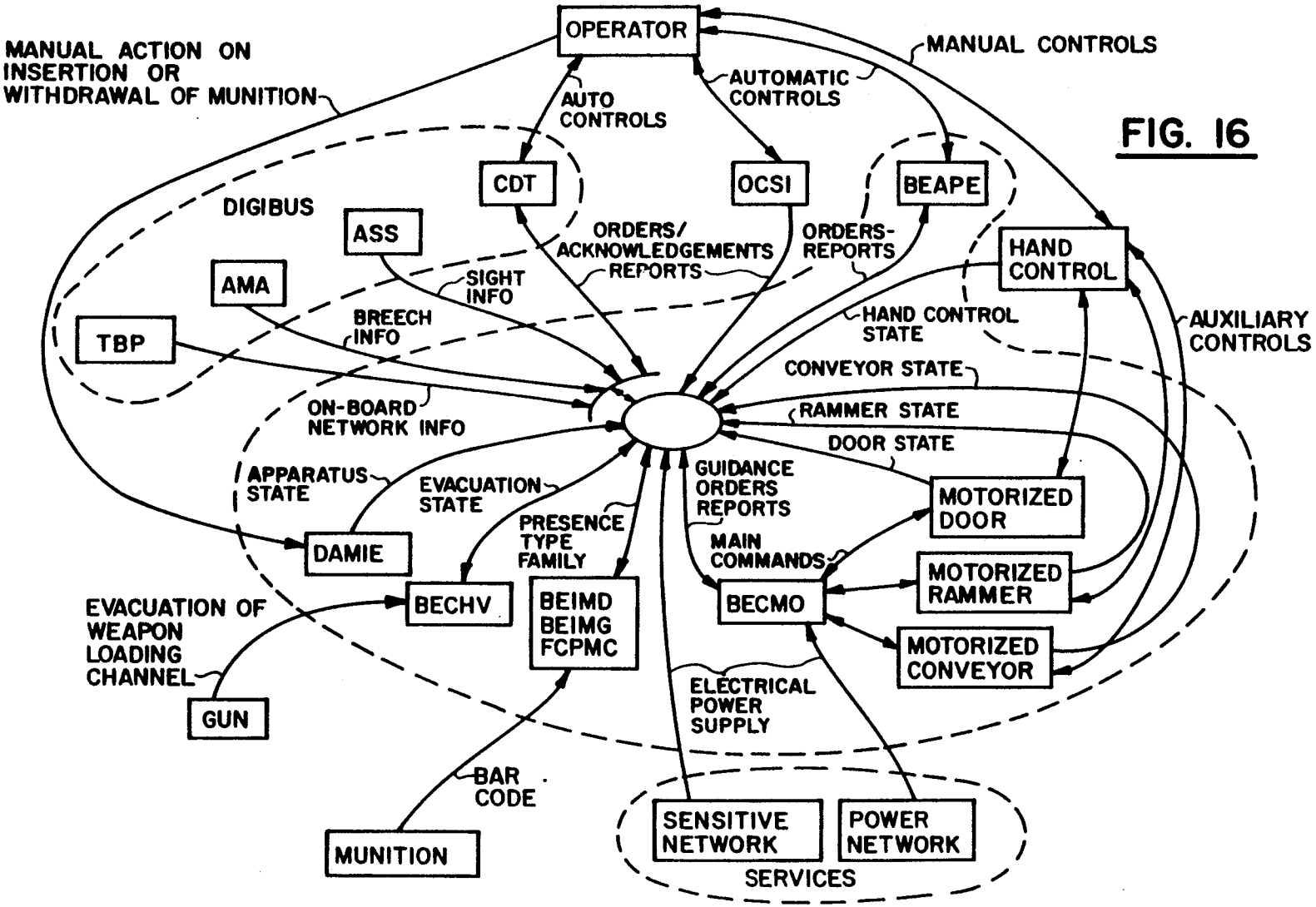
FIG. 16 is an intermediate flow diagram from which flows the physical architecture of the device according to the invention.

FIG. 16 illustrates an intermediate functional architecture from which the physical architecture of the device according to the invention, already described with reference to FIGS. 1 to 7B, arises.

The following elements are distinguished:

CONVEYOR: munition transporting mechanism 5 with electric motor 7 (magazine).

RAMMER: munitions transfer mechanism 9 with electric motor 11.

DOOR: protection mechanism 14 with electric motor 16.

BECAL: calculator housing 13 charged with guiding the mechanisms using sensors and actuators, under the supervision of the OCSI and DIGIBUS channels.

BECMO: control housing 8 charged with guiding the motors which equip the door, the rammer and the conveyor.

BEAPE: operator dialog interface 17 for external provisioning/evacuating.

DAMIE: device 21 (FIG. 1) for extracting and inserting a munition into a conveyor cell.

BECHV: sensor 36 (FIG. 2) intended for evaluating the state of evacuation of the loading path.

BEIMD, BEIMG: redundant sensors 30, 31 (FIG. 2) charged with reading the munition bar codes.

FCPMC: sensor 12 (FIG. 2) charged with guaranteeing the presence of a munition in the loading station, during a ramming.

Various sensors (not shown):

BECOD: absolute coder 19 (FIG. 2) of conveyor position.

FCPFE, FCPOU: sensor 34, 35 (FIG. 2) of open/-closed door state.

FCRRE: sensor 27 (FIG. 2) of returned rammer state.

FCORE: sensor 28 (FIG. 2) of locked apparatus state.

It is observed in FIG. 16 that:

DIGIBUS is a channel to which the AMA, ASS, TBP, CDT subsystems are attached.

The SERVICES occupy two networks, one for BECAL, the other for BECMO, so as to isolate the power elements from the control elements.

The intrinsic distribution of the functions is as follows:

Selection function.

This implements the BECAL computer 13 which receives the selection order through the OCSI or DIGIBUS channel. The latter controls the BECMO power interface 8 charged with actuating the motorization of the CONVEYOR 5. The sequence or algorithm for positioning the CONVEYOR is executed by the computer 13 by means of the sensors of BECOD position 19 and of BEIMD, BEIMG, FCPMC identification 30, 31, 12.

Manual control of this function is carried out by the operator via an auxiliary motor which equips the conveyor. During automatic sequences the manual interventions of the operator are requested by the computer 13.

Loading function.

This employs the BECAL computer 13 which receives the loading order through the OCSI or DIGIBUS channel. The latter controls the BECMO power interface 8 charged with actuating the motorizing 11 of the RAMMER 9.

The sequence or algorithm for returning or dispatching the rammer 9 is executed by the computer by means of FCRRE, BECHV sensors 27, 36 and of BECMO and AMA and ASS subsystem information. The manual movements of the RAMMER are conditioned and implemented in the same way as for the CONVEYOR.

Protection function.

This employs the BECAL computer 13 which, if necessary, controls the BECMO power interface 8 charged with actuating the motorizing of the door 14.

It may be solicited by the loading function described previously.

The sequence or algorithm for opening or closing the door is executed by the computer by means of the FCPFE, FCPOU sensors 34, 35.

The BECHV "empty chamber" sensor 36 is mounted physically on the door 14 since the latter is situated on the ramming axis.

Provisioning/evacuating function.

This uses the selection function when it is necessary to perform a rotation of the CONVEYOR. Furthermore, it employs the BECAL computer which receives the provisioning/evacuating order by the DIGIBUS and OCSI channels or (in automaton mode) by the BEAPE housing 26 (FIG. 2).

This computer runs the corresponding algorithm under the control of the operator who has available as dialog interface:

under external operation: the BEAPE housing 26 under internal operation: DIGIBUS OCSI operator consoles

The manual provisioning/evacuating device D.AMIE is reversible so as to permit internal as well as external use. It is equipped with the FCORE sensor 28 whose state is exploited by the computer. Identification of the munitions and the state of the cells are given by the BEIMD, BEIMG, FCPMC sensors 30, 31, 12. The information from them is exploited internally by the computer charged with managing and protecting them.

Automaton management function.

This is fulfilled by the computer 13. It constitutes the central control element of the automatic unit for automatic loading. In particular, it is charged with managing communication with the other subsystems, with ensuring the security of the CHA, with preserving these operating parameters and with accepting or otherwise the execution of an order coming from the operator.

The task of the software installed in the BECAL computer, through its hardware environment, is to:

1) produce the DIGIBUS dialog interface, produce the OCSI dialog interface.
2) produce the positioning of the mechanisms: RAMMER, CONVEYOR, DOOR.
3) ensure the security of the subsystem,
4) perform the auto-diagnosis of the subsystem,
5) execute the sequences relating to the orders, in a condition of nominal or degraded function.

In particular:

lookout,
selection,
loading,
provisioning,
evacuating,
automatic or manual triggered tests.

Figure 17:
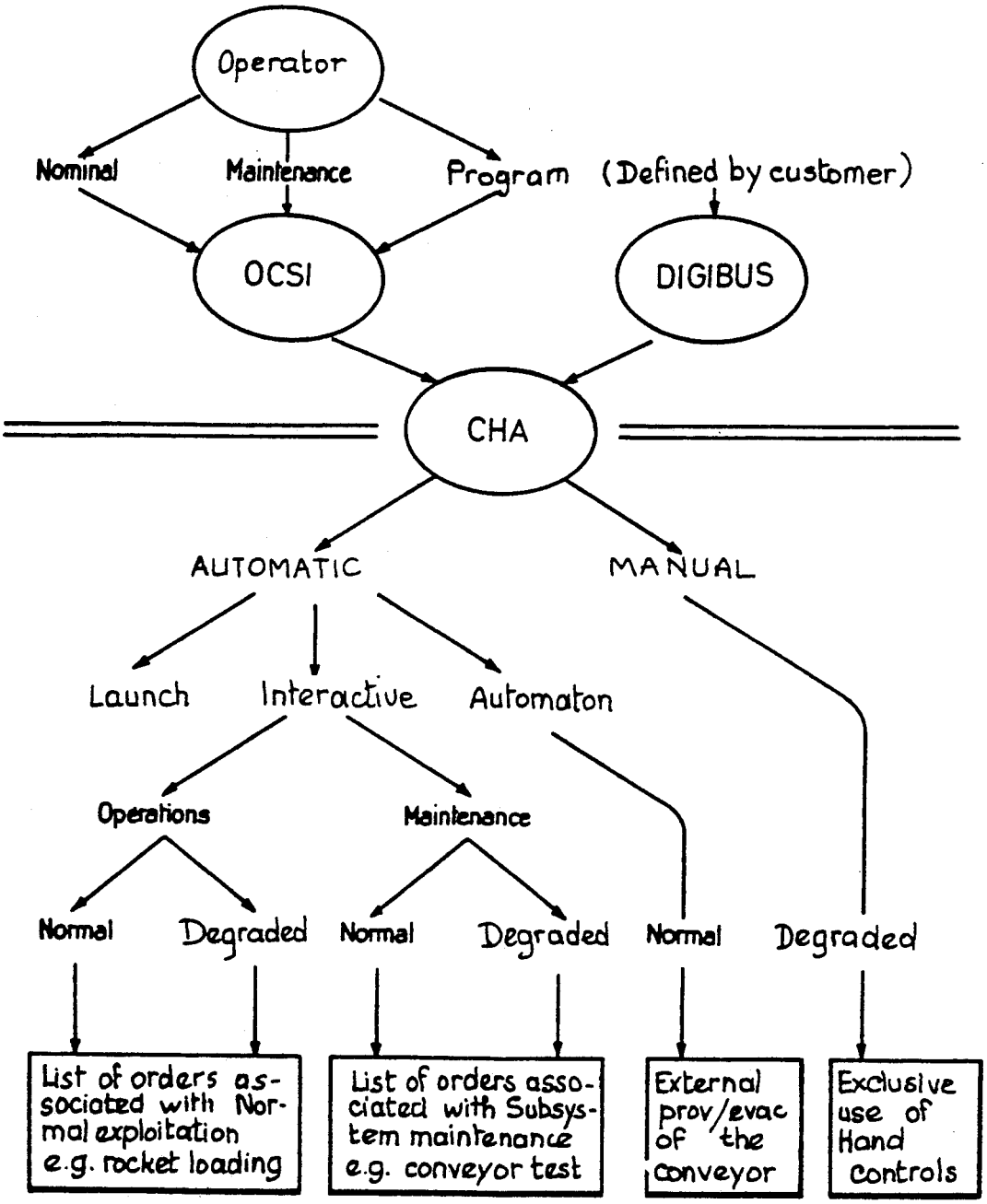
FIG. 17 represents the tree diagram for the operating conditions of the device according to the invention.

The internal modes of operation of the device will be examined with reference to FIG. 17.

These involve the following modes:

The normal mode characterizes the nominal operation of the CHA. It entails complete availability and non-degraded performance of the subsystem.

The degraded mode characterizes the non-nominal operation of the CHA. It indicates that the subsystem is incapable of accomplishing its task without human intervention. This mode is also referred to as semi-automatic or manual. The subsystem possesses more or less degraded performance.

The operational mode materializes the context in which the CHA guarantees its ability to process all the orders expected during an operational implementation.

The maintenance mode is the one in which the CHA executes the orders reserved for maintenance of the subsystem. It involves locating the broken-down functional elements which characterize degraded operation.

The launch mode is the one in which the subsystem is placed under power in order to indicate that it is in a phase of hardware and software initialization.

The interactive mode is the usual mode of operation of the CHA characterized by the interaction of the exchanges between the subsystem and its environment.

In this mode all the options for using the CHA can be implemented.

The automaton mode is the one to which the CHA is confined in the event of BUS silence (particular DIGIBUS anomaly). Only the external provisioning/evacuating operations can be carried out. The disappearance of the BUS silence induces the subsystem to return to an interactive mode of operation once the operation in progress has terminated.

The automatic mode is the mode of use which requires the operation of the automatic unit (automatic management of the CHA and of its movements).

The manual mode is the mode available to the operator by default if the subsystem is switched off or has broken down. If the subsystem is operating automatically, the operator imposes the manual mode, by operating the hand controls (handles 22, 23, FIG. 1).

Under these conditions, the CHA remains powered-up, but no longer ensures neither monitoring nor management (the operator uses the CHA as he pleases). As a general rule, this is the attitude adopted in the event of a serious breakdown or complete unavailability.

The CHA is said to have broken down when it is completely unavailable. However, the subsystem is also regarded as having broken down if it accepts nothing but manual operation.

Insofar as the automaton management function is working, despite the state of breakdown which it may be in, the subsystem permits the execution of the triggered tests which are required for its maintenance.

If the operator indicates an end to the manual operating, the CHA returns to an automatic mode of operation.

The operator/tank interface uses the DIGIBUS functional interface 41 which will be described later.

The control message emanates from the FIRE guidance through which cross the orders and the ackowledgements of the operator.

Moreover, with the device there is associated an interface intended for a workshop-based operator with a view to ensuring the checking or maintenance of the device.

In the present example, this interface uses a terminal of the type with touch-sensitive screen.

The screen of this terminal is divided into two main zones:

A zone for service messages. The messages are written "in the streamline".

A one for operator dialog. This is itself partitioned into:

a field of control keys,
a field of menu keys,
a field reserved for instructions given to the operator.

The control keys enable the operator to act directly on the operation, to acknowledge a request issued by the CHA or to modify the operating parameters of the CHA.

The menu keys enable the operator to formulate the desired action. At the start, the operator chooses between three modes of operation:

Nominal mode: he has access to the loading, lookout, selection, provisioning and evacuating orders.

Maintenance mode: he has access to everything related to the elementary movements, the tests, the modifications of states of the elements or of the environment; and, he can modify the information from the permanent memory.

Program mode: in this mode he calls up, lists or modifies a program with certain particular instructions. So far as the calling-up of the actions to be taken is concerned, this is done via the menus of the preceding modes. He has the option of giving the execution number for the program. He can start it, stop it, continue it or abandon.

In certain cases, for example in Program mode, when listing, the zone reserved for service messages can be reduced.

Whilst scrolling menus, the operator may have occasion to give numerical values. For such cases a numerical keyboard appears in menu form.

The BEAPE housing 26 of the schematization shown in FIG. 2 makes it possible:

1) for the CHA to indicate to the operator:
   if the provisioning is authorized,
   if the evacuating is authorized,
   if the munition is not recognized; and,
2) for the operator to indicate to the CHA:
   if it is an evacuation operation which he wishes to perform,
   if it is an evacuation operation which he wishes to terminate, wishes to perform,
   if it is a provisioning operation which he wishes to terminate,
   the type of munition inserted,
   if he rejects the sequence in progress.
3) to block the CHA in an emergency stop condition (security) for possible inspection of a tube. The suspended sequence begins to run again once the emergency stop is re-engaged.

The device just described makes it possible to proceed with the automatic loading of the munitions into an artillery piece, in particular a tank gun with maximum security as regards the choice of the munition, maximum rapidity of implementation and minimum risk and effort for the personnel.

We claim:

1. An apparatus for controlling the automatic loading of a gun of an armored vehicle gun turret, comprising:

a rotating magazine having cells for storing munitions, the rotating magazine being disposed in proximity to a chamber of the gun; p1 a rammer for ramming munitions stored in the rotating magazine towards a chamber of the gun;

at least one munition type sensor for detecting a type of munition stored in a cell of the rotating magazine;

means for selecting a type of munition to be used;

control means for controlling the rotating magazine to position a selected type of munition for loading into the chamber of the gun, for controlling the rammer to ram the selected type of munition towards the chamber of the gun, and for controlling a transfer of the selected munition from the rammer towards the chamber of the gun; and managing means for managing the munitions stored in the rotating magazine and instructing the control means based on the output of the munition type sensor and the selecting means, wherein the managing means is disposed on board the armored vehicle and comprises, a central processing unit;

memory means for storing munitions automatic loading instructions for the central processor unit, time dependent data of the automatic loading operation, data computed by the central processor during execution of the automatic loading instructions;

a first and second serial link input/output circuits;

a external communications circuit for communicating with the outside;

at least one voltage conversion board; and a central processing bus for interconnecting the central processing unit, memory means, first and second serial links input/output circuits, external communications circuit, and voltage conversion board.

2. The apparatus of claim 1, wherein the munition type sensor recognizes codes carried by each munition to detect the types of the munitions.

3. The apparatus of claim 2, wherein a first and second munition type sensor are disposed on either side of the rammer.

4. The apparatus of claim 1, wherein the central processing unit comprises:

a microprocessor;
first buffer circuit;
a priority coder;
a controller for controlling access time to the memory means;
a logic circuit for prioritizing interrupts to the controller;
an isolating circuit;
a watchdog memorizing circuit;
a decoding logic circuit;

timing circuits connected to the isolating circuit, watchdog memorizing circuit, and the decoding logic circuit;

a control bus interconnecting the microprocessor, the first buffer circuit, the controller, the logic circuit, and the timing circuits.

5. The apparatus of claim 4, wherein the central processing unit further comprises:

second and third buffer circuits;

an address bus interconnecting the microprocessor, the second buffer circuit, and the decoding logic unit; and a data bus interconnecting the microprocessor, the third buffer circuit, and the timing circuits.

6. The apparatus of claims 1, wherein the memory means comprises:

a block of read only memories storing the munitions automatic loading instructions for the central processor unit;

a block of backed-up memories storing the time dependant data of the automatic loading operation;

a block of random access memories storing the data computed by the central processor during execution of the automatic loading instructions.

7. The apparatus of claims 5, wherein the memory means comprises:

a block of read only memories connected to the data and address buses, the block of read only memories storing the automatic loading instructions for the central processor unit;

a block of backed-up memories connected to the data and address buses, the block of backed-up memories storing the time dependant data of the automatic loading operation;

a block of random access memories connected to the data and address buses, the block of random access memories storing the data computed by the central processor during execution of the automatic loading instructions.

8. The apparatus of claim 7, wherein the memory means further comprises:

a line of selection bits;

a decoding logic unit connected to the block of read only, back up and random access memories, the address bus, and the line of selection bits;

a logic unit for managing exchanges of information between the central processing unit and the memory means and for generating error signals in response to information exchange errors;

a counter connected to the logic unit for generating a first control signal based on a clock signal; and fourth, fifth, and sixth buffer circuits connected to the data, address, and control buses, respectively.

9. The apparatus of claim 1, wherein each of the first and second serial link input/output circuits comprise:

a first and second serial link controlled by the central processing unit;

a first input port with a plurality of all-or-nothing inputs for inputting the enabling state of peripheral devices;

a first output port with a plurality of all-or-nothing outputs for outputting control information to peripheral devices;

at least one I/O bus interconnecting the first and second serial links, and the first input and output ports.

10. The apparatus of claim 1, further comprising:

a door which separates the rammer and the chamber of the gun;

a first electric motor for driving the rotating magazine;

a second electric motor for driving the rammer;

a third electric motor for driving a door which separates the rammer and the chamber of the gun; and wherein the control means comprises motor control means for controlling a the first, second and third electric motors.

11. The apparatus of claim 10, wherein the control means comprises:

a single power supply means for supplying power to the first, second, and third electric motors, the single power supply supplying power to only one of the first, second and third electric motors at a time;

a speed control means for controlling a speed of the first, second and third electric motors; and a module means for selecting one of the first, second and third electric motors to be powered.

12. The apparatus of claim 11, wherein the control means further comprises:

a check circuit for checking the single power supply, the first, second and third electric motors and for generating speed setpoints for the first, second and third electric motors;

a serial interface circuit for connecting the control means to the managing means; and a general connector for outputting data to the outside.

13. The apparatus of claim 12, wherein the single power supply means comprises:

a power bridge formed of two half-bridges for controlling the rotation of an electric motor; each half-bridge having two transistors and a transistor control circuit; and a filtering module connected to the bridge for distributing electrical energy.

14. The apparatus of claim 13, wherein the check circuit comprises:

a circuit for monitoring a temperature of the half-bridges;

circuit for monitoring a power supply for the transistor controllers of each half-bridge;

a setpoint generating circuit;

a direction of rotation circuit receiving the output of the setpoint generating circuit to determine a rotational direction of an electric motor;

a null set point circuit connected to the direction of rotation circuit;

an emergency stop monitoring circuit for stopping an electric motor in response to an emergency stop command signal;

a circuit for checking an overload of an electric motor;

an isolating switch circuit receiving the output of the circuit for checking the overload and the emergency stop monitoring circuit;

a circuit for monitoring a temperature of the first, second and third electric motors; and wherein the circuit for monitoring a temperature, the circuit for monitoring a power supply, the direction of rotation circuit, the null set point circuit, the emergency stop monitoring circuit, the circuit for checking an overload, and the isolating switch circuit are connected to the general connector: and the circuit for monitoring a temperature, the circuit for monitoring a power supply, the setpoint generating circuit, the isolating switch circuit and the circuit for monitoring a temperature of the first, second and third electric motors are connected to the serial interface circuit.

15. The apparatus according to claim 13, wherein the selection module comprises:

a set of switches for connecting the power bridge to one of the first, second, and third electric motors; in response to a command signal from the managing means;

a switch control circuit for controlling the switches in response to a command signal from the managing means;

a current detector for detecting a current supplied to the set of switches;

an authorization generator for authorizing a switching operation based on the output from the checking circuit and the current detector;

a brake circuit for controlling breaking of a motor and generating braking information for use by the managing means;

a selection check circuit for checking a selection of the switch control means; and wherein a bus interconnects the selection module, the check circuit, the serial interface circuit, and the first, second and third electric motors.

16. The apparatus of claim 15, wherein the speed control means comprises:

a circuit for reconstructing a back electromotive force of an electric motor;

a first summation circuit summing an output of the reconstructing circuit and the direction of rotation circuit;

a first correction means for correcting output of the first summation circuit;

circuit for resetting overload to zero based on output from the circuit for checking an overload and the current detector;

a second summation means for summing outputs from the current detector and the first correction means;

a second correction means for correcting output from the second summation means; and a control signal generator for outputting a second control signal to the transistor control circuits.

17. The apparatus of claim 12, wherein the serial interface circuit comprises:

a transmitter serial/parallel interface circuit;

a first multiplexer connected to the transmitter serial/parallel interface circuit;

a receiver serial/parallel interface circuit connected to the transmitter serial/parallel interface circuit; and a second multiplexer circuit connected to the receiver serial/parallel interface circuit. parallel interface circuit.

* * * * *

UNITED STATES PATENT AND TRADEMARK OFFICE

CERTIFICATE OF CORRECTION

PATENT NO. : 5,233,125

DATED : August 3, 1993

INVENTOR(S) : BOUVET, Gerard et al.

It is certified that error appears in the above-identified patent and that said Letters Patent is hereby corrected as shown below:

On the Title page:

Item [19], the first line thereunder, the inventor's name should read:

-- Bouvet et al. --

Item [75], the first-named inventor's name should read

-- Gerard Bouvet --

Signed and Sealed this

Eighth Day of March, 1994

Bruce Lehman

*Attest:*

BRUCE LEHMAN

*Attesting Officer*

*Commissioner of Patents and Trademarks*